US008496245B2

(12) United States Patent
Kozlowski

(10) Patent No.: US 8,496,245 B2
(45) Date of Patent: Jul. 30, 2013

(54) DOUBLE DOCUMENT DETECTION APPARATUS AND A METHOD FOR CONDUCTING THE SAME

(75) Inventor: William Lawrence Kozlowski, Novi, MI (US)

(73) Assignee: Burroughs, Inc., Plymouth, MI (US)

( * ) Notice: Subject to any disclaimer, the term of this patent is extended or adjusted under 35 U.S.C. 154(b) by 0 days.

(21) Appl. No.: 13/245,034

(22) Filed: Sep. 26, 2011

(65) Prior Publication Data

US 2013/0075970 A1 Mar. 28, 2013

(51) Int. Cl.
*B65H 7/12* (2006.01)
*B65H 7/02* (2006.01)

(52) U.S. Cl.
USPC ..... 271/262; 271/265.04; 271/263

(58) Field of Classification Search
USPC ..... 271/262, 263, 265.04
See application file for complete search history.

(56) References Cited

U.S. PATENT DOCUMENTS

| | | | | |
|---|---|---|---|---|
| 6,364,556 | B1 * | 4/2002 | Barbera et al. | 400/708 |
| 7,654,521 | B2 * | 2/2010 | Simonis et al. | 271/262 |
| 7,770,890 | B2 * | 8/2010 | Ohnishi et al. | 271/298 |
| 8,047,541 | B2 * | 11/2011 | Segawa | 271/265.04 |
| 2003/0006550 | A1 * | 1/2003 | Chujo et al. | 271/262 |
| 2008/0088084 | A1 * | 4/2008 | Shimazaki | 271/262 |
| 2008/0284093 | A1 * | 11/2008 | Itoh et al. | 271/262 |
| 2009/0315251 | A1 * | 12/2009 | Hancock et al. | 271/18 |
| 2010/0117295 | A1 * | 5/2010 | Miyamoto | 271/265.04 |
| 2011/0084443 | A1 * | 4/2011 | Iino | 271/228 |

* cited by examiner

*Primary Examiner* — Patrick Cicchino
(74) *Attorney, Agent, or Firm* — Honigman Miller Schwartz and Cohn LLP

(57) ABSTRACT

An apparatus is disclosed. The apparatus includes a document processor and electronics connected to the document processor. The electronics includes a document sensor system and means for determining a document processing situation of a plurality of document processing situations. The document sensor system is connected to the means. The plurality of document processing situations include a single document situation and a double document situation. The double document situation includes a partially-overlapped, double document situation and a completely overlapped, double document situation. A method is also disclosed.

4 Claims, 17 Drawing Sheets

11B'
11B''
11B'''
John Smith
1234 Shady Lane
Yourtown, State 01234-5678
7777
12-345/6789
July 2
19 00
PAY TO THE ORDER OF
PAY
4310
$ 100.00
DOLLARS
NON NEGOTIABLE
MEMO
D
D4
D1
DF
DR
T1
T4

DOUBLE DOCUMENT DETECTION APPARATUS AND A METHOD FOR CONDUCTING THE SAME

TECHNICAL FIELD

The disclosure relates to a double document detection apparatus and a method for conducting the same.

BACKGROUND

Document processing machines are known in the art. Although known document processing machines perform adequately for their intended use, improvements are nevertheless continuously being sought in order to advance the art.

DESCRIPTION OF THE DRAWINGS

The disclosure will now be described, by way of example, with reference to the accompanying drawings, in which:

FIG. 11B" is a cross-sectional view of both of the two partially overlapped exemplary documents according to line 11B"-11B" of FIG. 11A, illustrating an exemplary thickness of both of the two partially overlapped exemplary documents.

FIG. 11B'" is a cross-sectional view of a second document of the two partially overlapped exemplary documents according to line 11B'"-11B'" of FIG. 11A, illustrating an exemplary thickness of the second document of the two partially overlapped exemplary documents.

DETAILED DESCRIPTION

Figures 1A, 2A:
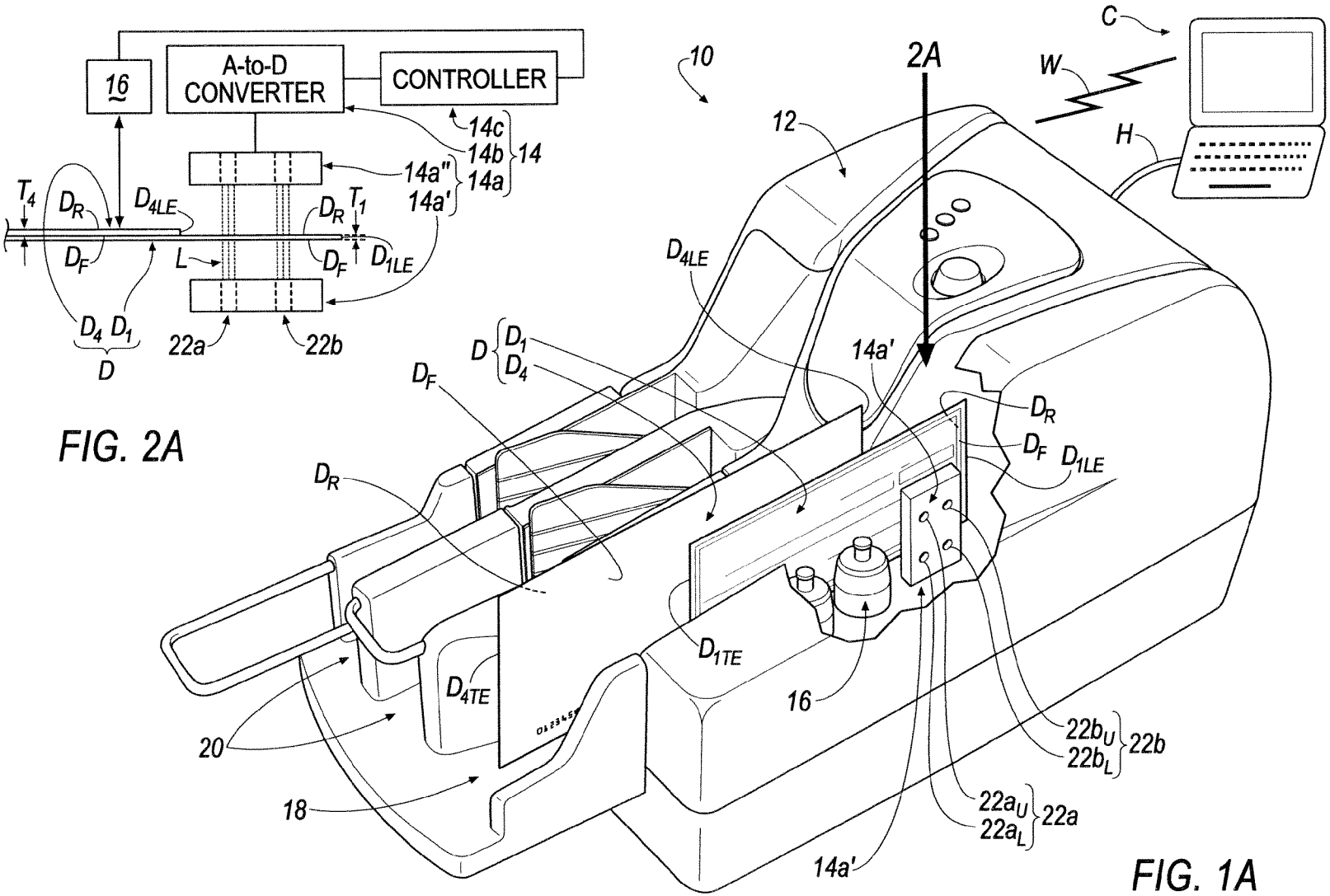
FIGS. 1A-1C illustrate front perspective, partial broken views of an exemplary document processing apparatus.
FIGS. 2A, 2B, 2C illustrate a sensor system and a pair of partially-overlapped documents according to lines 2A, 2B, 2C of FIGS. 1A, 1B, 1C.

The figures illustrate an exemplary implementation of a double document detection apparatus and a method for conducting the same. Based on the foregoing, it is to be generally understood that the nomenclature used herein is simply for convenience and the terms used to describe the invention should be given the broadest meaning by one of ordinary skill in the art.

FIGS. 1A-1E illustrate an exemplary implementation of an apparatus 10 that processes at least one document, D (see also $D_1$, $D_2$, $D_{3A}$, $D_{3B}$, $D_4$, in FIGS. 8A-11B'"). Accordingly, in an implementation, the apparatus 10 may be referred to as a "document processor." In an implementation, the at least one document, D, may include, but is not limited to, at least one financial/payment document (e.g., at least one check) or the like.

The processing of the at least one document, D, that is conducted by the document processor 10 may include the recording of and/or an analysis of one or more characteristics associated with one or more of a front surface, $D_F$, of the at least one document, D, and a rear surface, $D_R$, of the at least one document, D. In an implementation, the document processor 10 includes electronics 14 (see, for example, FIGS. 2A-2C) that may include analysis components (not shown) that perform, but is not limited to, one or more document processing application functions such as, for example: (1) imaging of one or more of the front and rear surfaces, $D_F$, $D_R$, of the at least one document, D, for recording an image of symbols and/or written indicia and/or printed indicia disposed upon one or more of the front and rear surfaces, $D_F$, $D_R$, of the at least one document, D, (2) converting the imaged symbols and/or written indicia and/or printed indicia upon one or more of the front and rear surfaces, $D_F$, $D_R$, of the document, D, into electronic form by way of, for example, optical character recognition (OCR) software, (3) magnetic ink character recognition (MICR) reading for magnetically identifying characters that are printed upon one or more of the front and rear surfaces, $D_F$, $D_R$, of the document, D, with magnetic ink (4) endorsing, (5) bar code reading, (6) biometric reading and the like. As described below, the electronics 14 may also detect a leading edge, $D_{1LE}$, $D_{4LE}$, or a trailing edge, $D_{1TE}$, $D_{4TE}$, of one or more documents, D.

In an implementation, the document processor 10 may include a communication interface that permits the document processor 10 to: receive commands from an operator and/or send processed document information to: a computer, C, database or the like. In an embodiment, the communication interface may permit wireless communication, W, or hardwired communication, H, to, for example, the computer, C, database or the like, by way of, for example, WiFi connection, an Ethernet connection, a Universal Serial Bus (USB) connection or the like.

In an implementation, the document processor 10 includes an outer protective shell 12. The outer protective shell 12 is supportably-connected to a baseplate (not shown) that supports the electronics 14 and one or more mechanical components 16 (see FIGS. 1A-1C) that contribute to the processing of the at least one document, D. The one or more mechanical components 16 may, for example, cause movement of the at least one document, D, along a document path such that the at least one document, D, may be transported through the document processor 10. The outer protective shell 12 and baseplate may include any desirable material such as, for example, plastic, metal or the like.

One or more of the outer protective shell 12 and the baseplate may cooperate to form a first pocket portion 18 and a second pocket portion 20. In an embodiment, the first pocket portion 18 may be referred to as an "input hopper" for receiving at least one un-processed document, D, and, in an embodiment, the second pocket portion 20 may be referred to as an "output bin" for receiving/storing at least one processed document, D.

The nomenclature associated with the at least one un-processed document, D, and the at least one processed document, D, may be dependent upon (1) the location of the at least one document, D, relative to the structure of the document processor 10 and (2) the un/successful performance of the one or more processing application functions applied to the at least one document, D, as the at least one document, D, is moved along the document path. For example, when the at least one document, D, is located/disposed within the input hopper 18, the at least one document, D, may be referred to as the at least one un-processed document, D; subsequently, when the at least one un-processed document, D, is (1) drawn out of/moved from the input hopper 18, then (2) passed through the document processor 10 along the document path in order to attempt to perform the one or more document processing application functions and then (3) deposited into the output bin 20, the at least one un-processed document, D, may then be referred to as the at least one processed document, D.

Figure 8B:
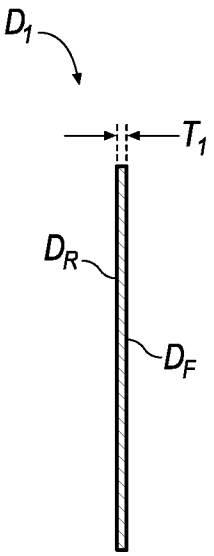
FIG. 8B is a cross-sectional view of the document according to line 8B-8B of FIG. 8A, illustrating an exemplary thickness of the non-overlapped document.
Figure 8A:
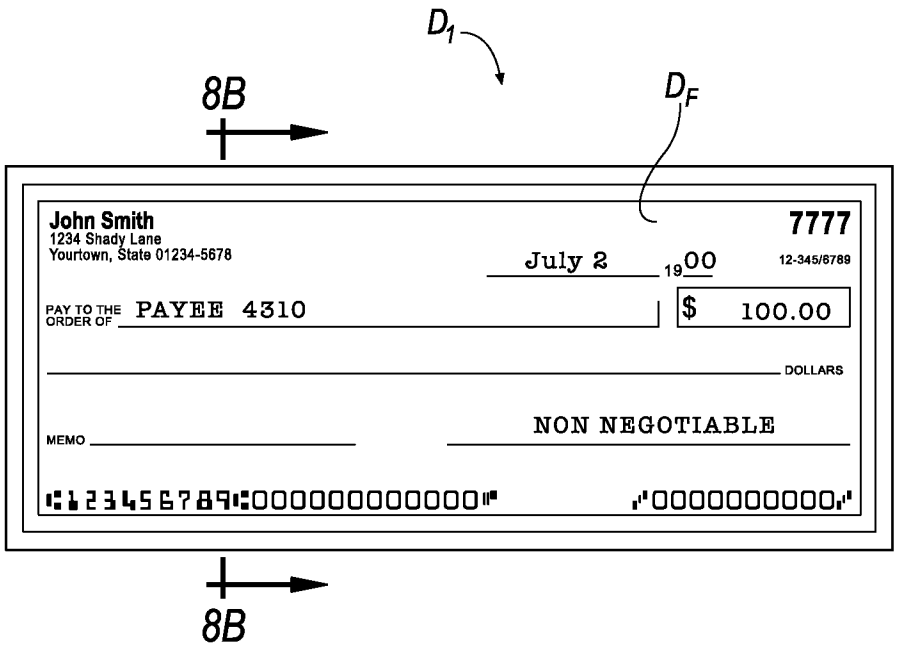
FIG. 8A is a front view of an exemplary, non-overlapped document.

Referring to FIGS. 8A-8B, a document that may be processed by the document processor 10 is shown generally at $D_1$. The document, $D_1$, includes a front surface, $D_F$, a rear surface, $D_R$, and a thickness, $T_1$. The document, $D_1$, may be characterized as a conventional paper-stock-based financial document, such as, for example, a check (that may be obtained from, for example, a perforated check book). The check, $D_1$, may be further characterized as having a paper density (i.e., a pound weight) equal to approximately about 20-to-24-pounds (noting that the term "density" as it is used here is not in the traditional sense of mass per unit volume, but, rather, a measure of area density).

Figure 9B:
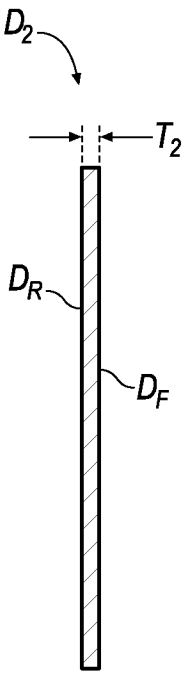
FIG. 9B is a cross-sectional view of the document according to line 9B-9B of FIG. 9A, illustrating an exemplary thickness of the non-overlapped document.
Figure 9A:
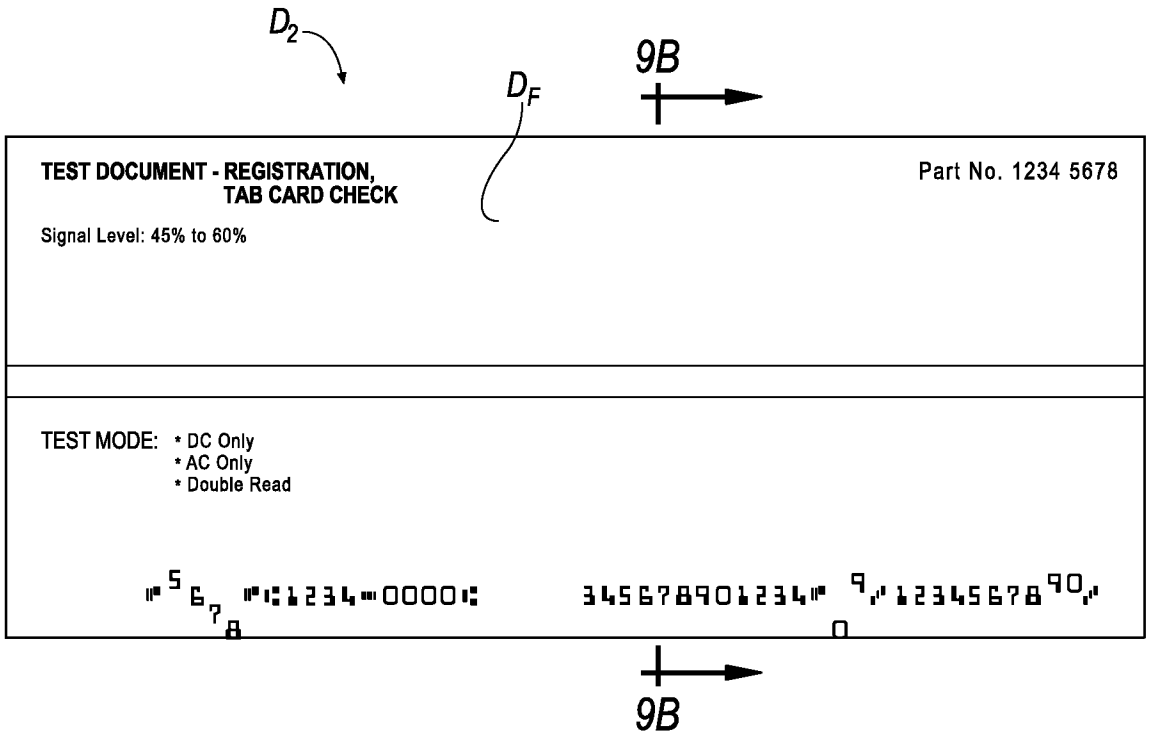
FIG. 9A is a front view of an exemplary non-overlapped document.

Referring to FIGS. 9A-9B, a document that may be processed by the document processor 10 is shown generally at $D_2$. The document, $D_2$, includes a front surface, $D_F$, a rear surface, $D_R$, and a thickness, $T_2$. The document, $D_2$, may be characterized as a conventional card-stock-based financial document, such as, for example, a check (that may have, for example, a higher durability [when compared to, e.g., the check, $D_1$] such that the check, $D_2$, may be mailed to, for example, a consumer in the form of, for example, a post card rebate check without being enclosed in a mailing envelope). The post card check, $D_2$, may be further characterized as having a paper density (i.e., a pound weight) that is greater than approximately about 24-pounds (noting that the term "density" as it is used here is not in the traditional sense of mass per unit volume, but, rather, a measure of area density).

Figure 10B:
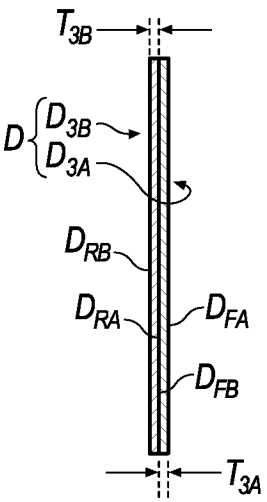
FIG. 10B is a cross-sectional view of the two completely overlapped exemplary documents according to line 10B-10B of FIG. 10A, illustrating an exemplary thickness of the two completely overlapped exemplary documents.
Figure 10A:
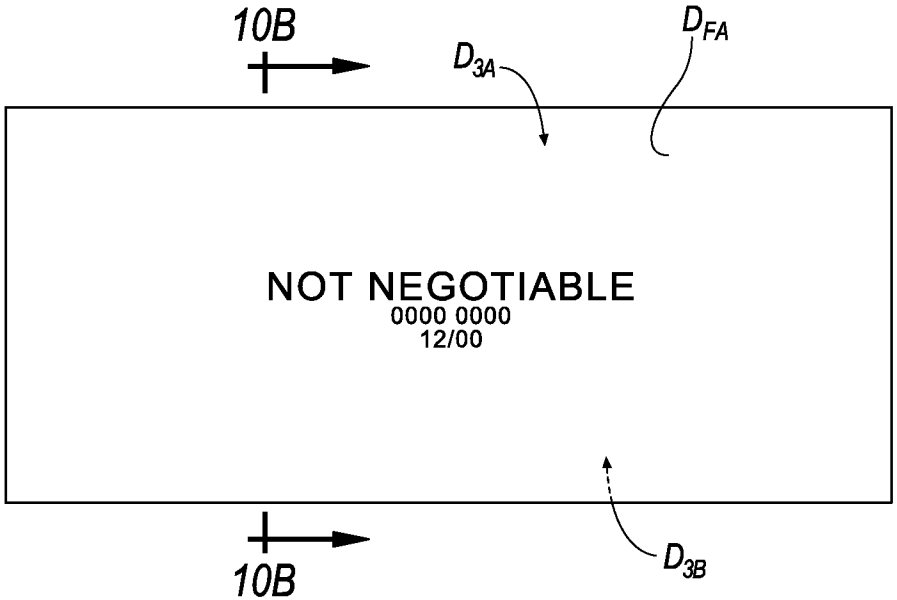
FIG. 10A is a front view of two completely overlapped exemplary documents.

Referring to FIGS. 10A-10B, at least one document, D, including a pair of documents that the document processor 10 may attempt to process are shown generally at $D_{3A}$, $D_{3B}$. The pair of documents, $D_{3A}$, $D_{3B}$, are aligned in manner such that the pair of documents, $D_{3A}$, $D_{3B}$, are described to be "completely overlapped." As described in the following disclosure, because the pair of documents, $D_{3A}$, $D_{3B}$, are completely overlapped, the document processor 10 may attempt to process the pair of documents, $D_{3A}$, $D_{3B}$, but, upon learning of the completely overlapped condition, the document processor 10 will cease the processing attempt (by, for example, deactivating the one or more mechanical components 16 that would otherwise continue to advance the pair of documents, $D_{3A}$, $D_{3B}$, through the document processor 10).

As seen in FIGS. 10A-10B, each document of the pair of documents, $D_{3A}$, $D_{3B}$, include a front surface, $D_{FA}$, $D_{FB}$, a rear surface, $D_{RA}$, $D_{RB}$, and a thickness, $T_{3A}$, $T_{3B}$. Each document of the pair of documents, $D_{3A}$, $D_{3B}$, may be characterized as a conventional paper-stock-based financial document, such as, for example, a check (that may be obtained from, for example, a perforated check book). Each document of the pair of documents, $D_{3A}$, $D_{3B}$, may be further characterized as having a paper density (i.e., a pound weight) equal to approximately about 20-to-24-pounds (noting that the term "density" as it is used here is not in the traditional sense of mass per unit volume, but, rather, a measure of area density).

Figures 11A, 11B:
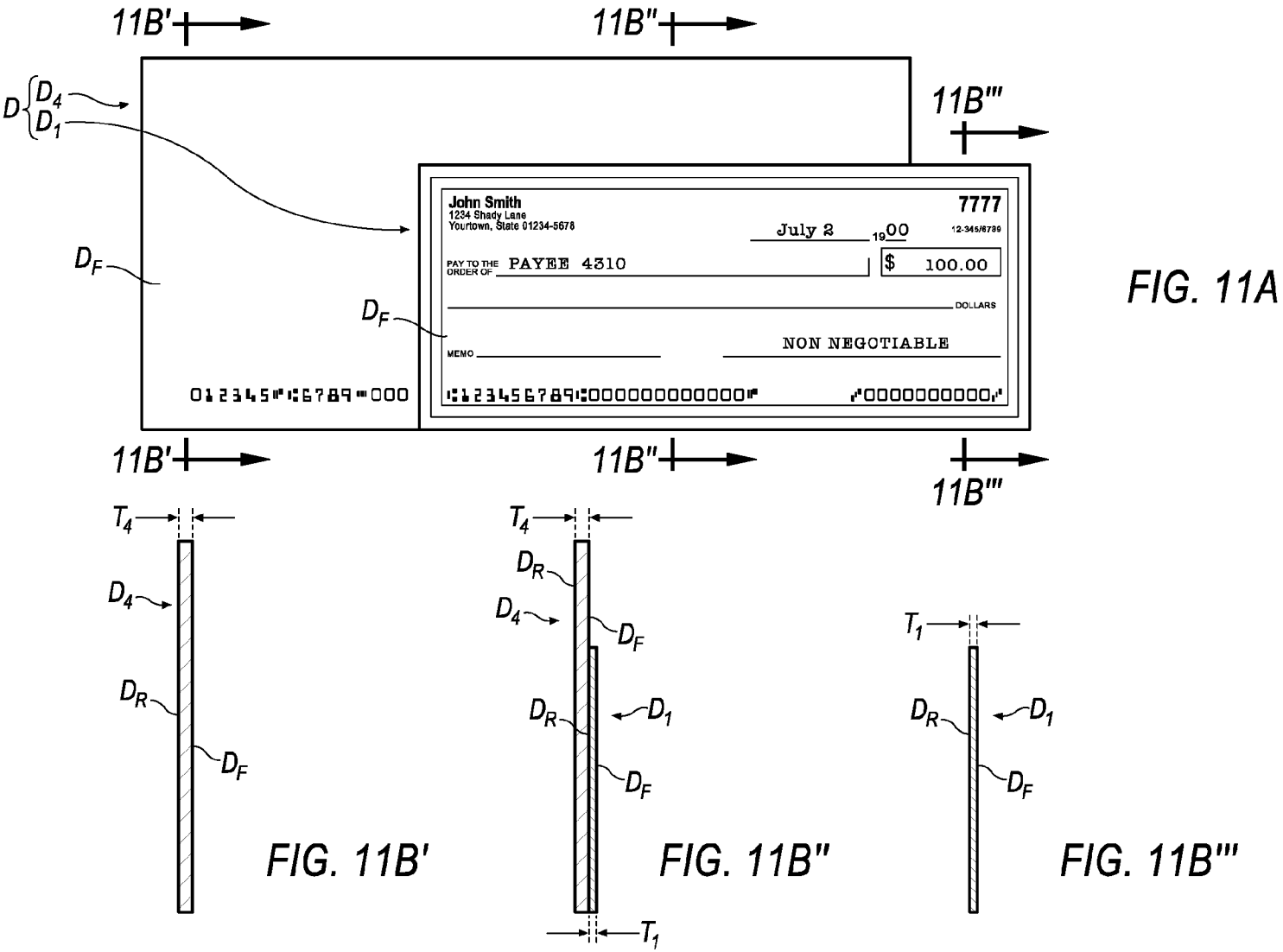
FIG. 11A is a front view of two partially overlapped exemplary documents.
FIG. 11B' is a cross-sectional view of a first document of the two partially overlapped exemplary documents according to line 11B'-11B' of FIG. 11A, illustrating an exemplary thickness of the first document of the two partially overlapped exemplary documents.

Referring to FIGS. 11A-11B'", at least one document, D, including a pair of documents that the document processor 10 may attempt to process are shown generally at $D_1$, $D_4$. The pair of documents, $D_1$, $D_4$, are aligned in manner such that the pair of documents, $D_1$, $D_4$, are described to be "partially overlapped." As described in the following disclosure, because the pair of documents, $D_1$, $D_4$, are partially overlapped, the document processor 10 may attempt to process the pair of documents, $D_1$, $D_4$, but, upon learning of the partially overlapped condition, the document processor 10 will cease the processing attempt (by, for example, deactivating the one or more mechanical components 16 that would otherwise continue to advance the pair of documents, $D_1$, $D_4$, through the document processor 10).

As seen in FIGS. 11A-11B'", each document of the pair of documents, $D_1$, $D_4$, include a front surface, $D_F$, a rear surface, $D_R$, and a thickness, $T_1$, $T_4$. Further, the first document, $D_1$, may include different geometric and inherent characteristics when compared to the second document, $D_4$; for example, the first document, $D_1$, may include a shorter height and length when compared to the second document, $D_4$, and, further, the first document, $D_1$, may be characterized as a conventional paper-stock-based financial document (having a paper density (i.e., a pound weight) equal to approximately about 20-to-24-pounds), whereas the second document may be characterized as a conventional card-stock-based financial document (having a paper density (i.e., a pound weight) that is greater than approximately about 24-pounds).

Figures 1B, 2B:
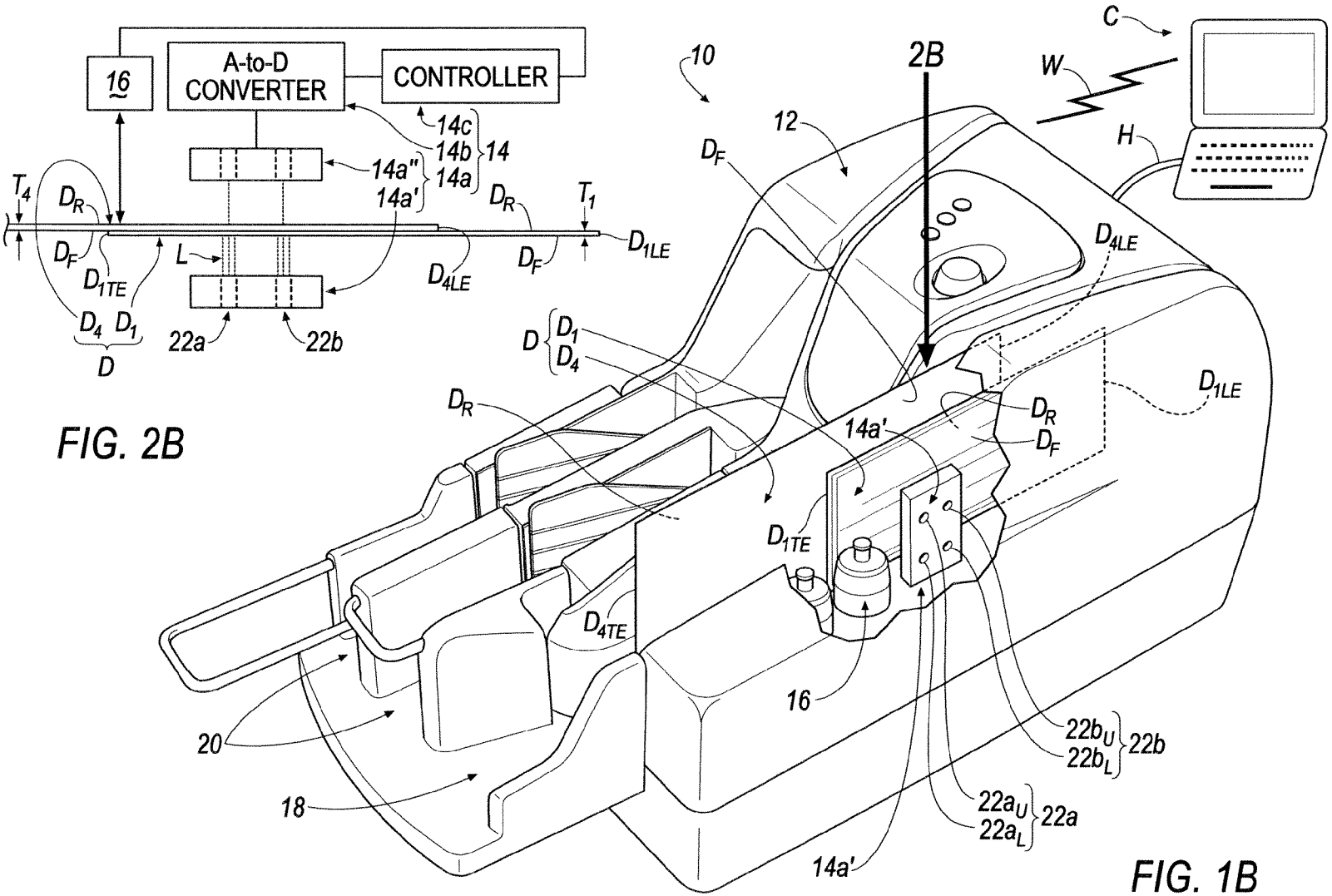
Figures 1C, 2C:
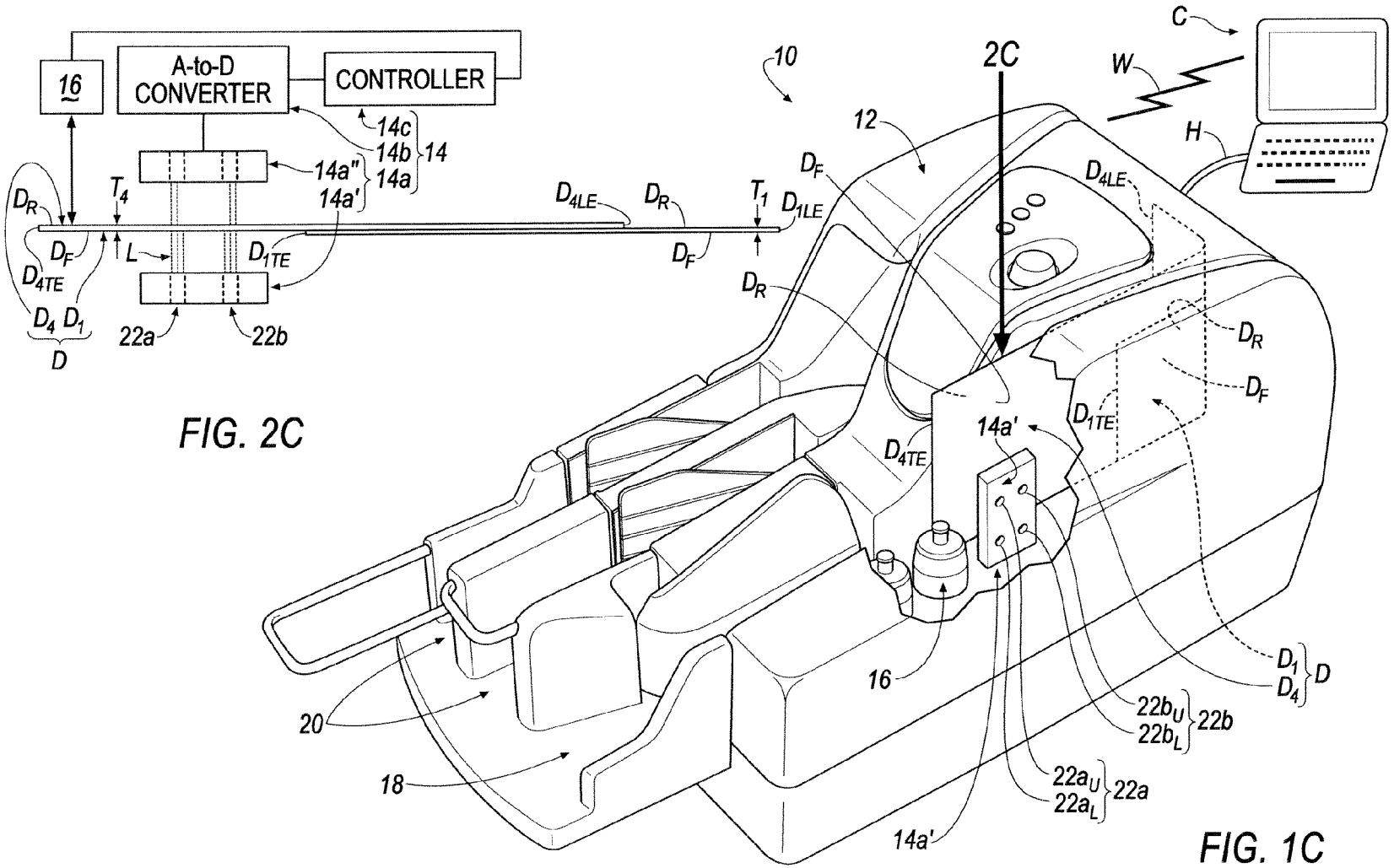

Referring to FIG. 1A, at least a portion (see reference numeral 14*a*') of the electronics 14 may be located proximate, but downstream of, the input hopper 18; the portion 14*a*' of the electronics 14 located proximate but downstream of the input hopper 18 may include a component of, for example, a sensor system 14*a* (see FIGS. 2A-2C). The one or more mechanical components 16 may be located proximate the input hopper 18 and may include at least, for example, a pair roller members that contribute to the advancing of the pair of documents, $D_1$, $D_4$ (e.g., the partially-overlapped documents from FIGS. 11A-11B'") from a location within the input hopper 18 to a different location (e.g., along the document path within the document processor 10) such that at least a portion of the document path may traverse at least, for example, the sensor system 14*a* (as shown in, e.g., FIGS. 2A-2C) and thereby permit the one or more documents, D, to move along the document path and also traverse the sensor system 14*a*.

As will be explained in the following disclosure, the electronics 14 may be utilized for detecting a "double document situation," which may include, for example, a "completely overlapped" document (see, e.g., FIGS. 10A-10B) or a "partially overlapped" document (see, e.g., FIGS. 1A-1E and FIGS. 11A-11B'"). A "double document situation" may occur as follows: a user may firstly deposit a plurality of documents within the input hopper 18 (see also step S.1 of algorithm 500 at FIGS. 12A-12B); due to the rapid processing of the plurality of documents by the document processor 10, in some circumstances, more than one document may be undesirably retrieved by the one or more mechanical components 16 at the same time, or, nearly at the same time, which may undesirably result in two or more documents being routed through the document processor 10 (as seen, for example, in FIGS. 1A-1C, 2A-2C) at approximately about the same time (i.e., which is a "partially overlapped double document situation"), or, at substantially the exact same time (i.e., which is a "double document situation"). Because a first document (see, e.g., the document, $D_1$, in FIGS. 1A-1C, 2A-2C) in a "double document situation" inhibit the processing (e.g., the imaging, MICR reading or the like) of a second document (see, e.g., the document, $D_4$, in FIGS. 1A-1C, 2A-2C due to the fact that a portion of the document, $D_1$, is arranged in front of the document, $D_4$) in the "double document situation", the processing operation to be conducted upon the second document by the document processor 10 may fail or otherwise be inhibited or prevented from occurring.

Further, in some circumstances, the electronics 14 may detect a financial document (see, e.g., the document, $D_2$, of FIGS. 9A-9B) that has a relatively greater thickness (see, e.g., the thickness, $T_2$, of FIGS. 9A-9B), which could be potentially misconstrued as a completely overlapped "double document situation" (see, e.g., the documents, $D_{3A}$, $D_{3B}$, of FIGS. 10A-10B having a collective thickness, $T_{3A}+T_{3B}$ that may be approximately equal to the thickness, $T_2$); accordingly, as will be explained in the following disclosure, the electronics 14 may be programmed to also take this situation into consideration and may discriminate a "double document situation" from a document (see, e.g., the document, $D_2$, of FIGS. 9A-9B) that has a relatively greater thickness (see, e.g., the thickness, $T_2$, of FIGS. 9A-9B). Accordingly, in view of what is stated above, it should be understood that upon detection of a "double document situation" by the electronics 14, the document processor 10 will cease a processing operation in order to permit, for example, a user, U (see FIG. 1E), to manually resolve the "double document situation" by, for example, manually removing the two or more documents from the document processor 10; the user, U, may then manually separate the two or more documents and interface each document (on an individual basis) with the document processor 10 at the input hopper 18 such that both documents may be processed (e.g., imaged, MICR'd or the like). However, if the electronics 14 detect a document having a greater thickness (see, e.g., the thickness, $T_2$, of FIGS. 9A-9B), the document processor 10 will, as explained in the following disclosure, discriminate the document, $D_2$, having the greater thickness, $T_2$, from a "double document situation" by comparing one or more sensor values to programmed/calculated "threshold values" and permit the document processor 10 to continue processing the single document (i.e., a non-overlapped document situation) having the greater thickness, $T_2$.

Referring to FIGS. 1A-1E, detection of an exemplary "double document situation" by the electronics 14 is described. As seen in FIGS. 1A-1C, the at least one document, D, including the pair of documents, $D_1$, $D_4$, of FIGS. 11A-11B'" are shown being pulled from the input hopper 18 and along the document path by the one or more mechanical components 16. Referring to FIGS. 2A-2C, the sensor system 14*a* may include a transmitter 14*a*' and a receiver 14*a*". The transmitter 14*a*' directly opposes the front surface, $D_F$, of the one or more documents, D, and the receiver 14*a*" directly opposes the rear surface, $D_R$, of the one or more documents, D.

The transmitter 14*a*' may include a first pair of light sources 22*a* and a second pair of light sources 22*b* (i.e., each of the transmitter 14*a*' and the receiver 14*a*" may be alternatively referred to as a "light transmitter" and a "light receiver"). Referring to FIGS. 1A-1C, each of the first and second pair of light sources 22*a*, 22*b* include an upper light source $22a_U$, $22b_U$ and a lower light source $22a_L$, $22b_L$ that are vertically spaced-apart from one another. In an embodiment, each of the upper and lower light sources $22a_U$, $22b_U$, $22a_L$, $22b_L$ may include an infrared light source that emits infrared light, L (see FIGS. 2A-2C), toward the front surface, $D_F$, of the one or more documents, D; however, the type of light source is not limited to an infrared light source emitting infrared light, and, accordingly, the first and second pair of light sources 22*a*, 22*b* may include any light source that emits any type of light.

As seen in FIGS. 2A-2C, the emitted infrared light, L (represented generally by three rays), is intended to be transmitted through the thickness (i.e., [1] $T_1$ alone as in FIG. 2A, [2] $T_4$ alone as in FIG. 2C, and [3] both of $T_1$ and $T_4$ together as in FIG. 2B) of the one or more documents, D, such that the infrared light, L, may be seen by/received at the receiver 14*a*". As seen in FIG. 2A, because the thickness, $T_1$, of the first document, $D_1$, is less than that of the thickness, $T_4$, of the second document, $D_4$, most (represented by the three rays of the infrared light, L) of the emitted infrared light, L, is incident upon/seen by the receiver 14*a*". As seen in FIG. 2C, because the thickness, $T_4$, of the second document, $D_4$, is greater than that of the thickness, $T_1$, of the first document, $D_1$, a lesser amount (represented by two rays of the infrared light, L) of the emitted infrared light, L, is incident upon/seen by the receiver 14*a*". As seen in FIG. 2B, because the combined thickness, $T_1+T_4$, of the first and second documents, $D_1$, $D_4$, is greater than that of the thickness, $T_4$, of the second document, $D_4$, when taken alone (as seen in FIG. 2C) an even lesser amount (represented by one ray of the infrared light, L) of the emitted infrared light, L, is incident upon/seen by the receiver 14*a*".

Referring to FIGS. 1A and 2A, the one or more mechanical components 16 moves the one or more documents, D, along the document path such that only a first document, $D_1$, of the pair of documents, $D_1$, $D_4$, traverse the sensor system 14*a* of the electronics 14. Referring to FIGS. 1B and 2B, the one or more mechanical components 16 further move the pair of documents, $D_1$, $D_4$, along the document path such that both of the first document, $D_1$, and the second document, $D_4$, of the pair of documents, D, traverse the sensor system 14*a*. Referring to FIGS. 1C and 2C, the one or more mechanical components 16 further move the pair of documents, $D_1$, $D_4$, along the document path such that only the second document, $D_4$, of the pair of documents, $D_1$, $D_4$, traverse the sensor system 14*a* of the electronics 14.

As described above, depending upon which document or both documents of the pair of documents, $D_1$, $D_4$, traverse the sensor system 14*a*, a different amount (i.e., approximately the same amount, a lesser amount or an even lesser amount) of the infrared light, L, is received by/seen by the receiver 14*a*". The receiver 14*a*" utilizes the amount of received infrared light, L, to derive an analogue value that is then communicated to an analogue-to-digital (hereinafter, "A-to-D") converter 14*b*, which may be a portion of the electronics 14. As seen in FIGS. 2A-2C, the A-to-D converter 14*b* may be communicatively-coupled to the receiver 14*a*"; alternatively, the A-to-D converter 14*b* and the receiver 14*a*" may be included in one component or device, chip or the like.

In an embodiment, as described above, the A-to-D converter 14*b* firstly obtains an analogue signal related to the amount of the received infrared light, L. Subsequently, the A-to-D converter 14*b* derives a digital signal by converting the received analogue signal into a digital signal that is then sent to a controller 14*c*, which may also be a portion of the electronics 14.

The digital signal output by the A-to-D converter 14*b* may be quantified as having a value, such as, for example, one byte that ranges between a value of zero (0) and two-hundred-and-fifty-five (255). In an embodiment, a digital value approximately equal to about two-hundred-and-fifty-five (255) means that the receiver 14*a*" is not saturated (i.e., little if none of infrared light, L, being seen by the receiver 14*a*" due to, for example, a thickness of the one or more documents, D, being large enough to block substantially all of the light, L, which could be construed as a "double document situation", or, the infrared light sources $\mathbf{22}a_U$, $\mathbf{22}b_U$, $\mathbf{22}a_L$, $\mathbf{22}b_L$ are not working or turned off). In an embodiment, a digital value approximately equal to about zero (0) means that the receiver 14*a*" is saturated (i.e., substantially all of the light, L, is being seen by receiving 14*a*" due to none of the one or more documents, D, being located between the transmitter 14*a*' and the receiver 14*a*".

Figure 3:
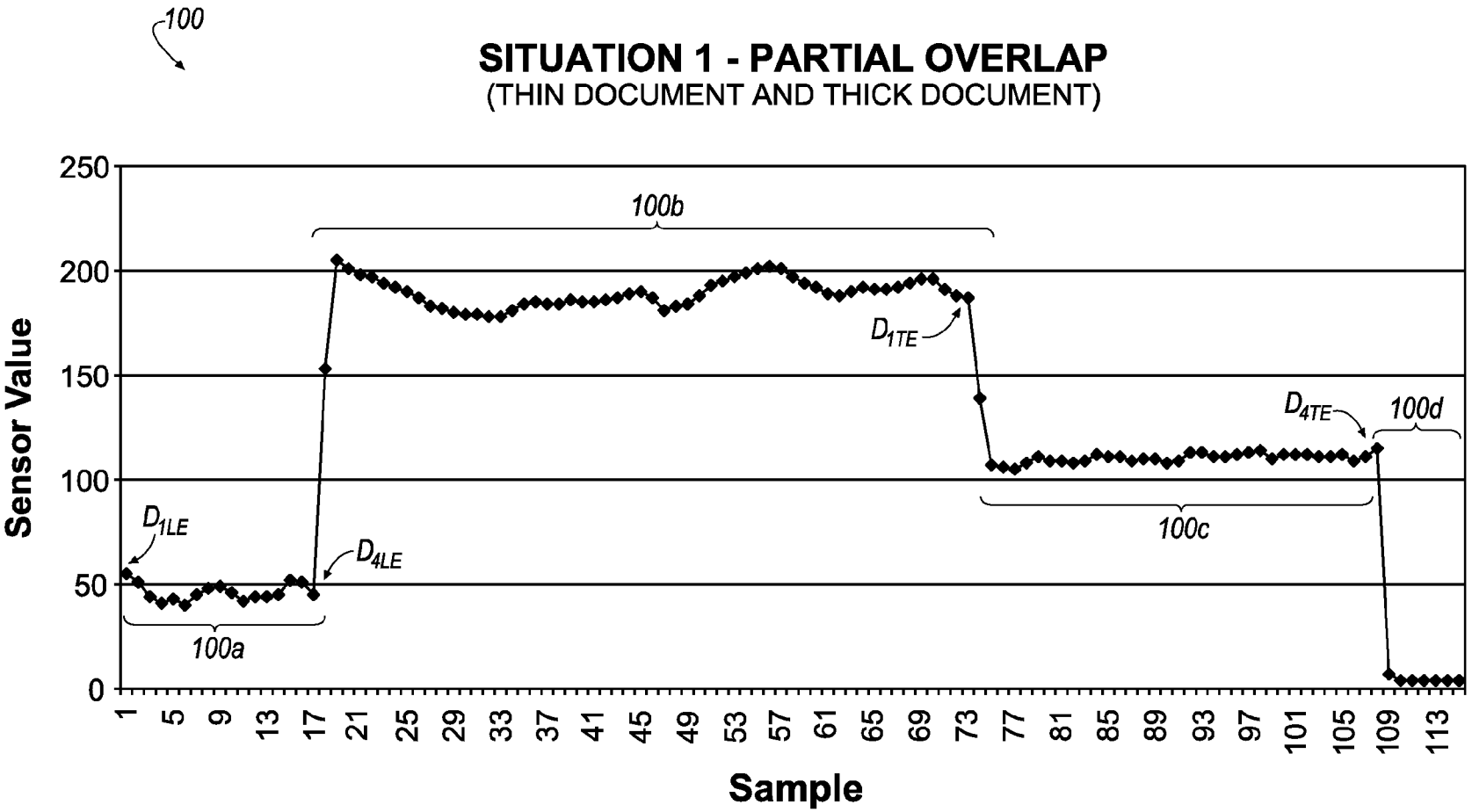
FIG. 3 illustrates an exemplary graph produced by the document processing apparatus that is interacting with the partially-overlapped documents of FIGS. 2A-2C.

Referring to FIG. 3, an exemplary graph 100 including a plurality of digital sensor value samples produced by the A-to-D converter 14*b* as a result of the partially-overlapped documents, $D_1$, $D_4$, interacting with the document processor 10 as described above at FIGS. 1A-1C and 2A-2C is shown according to an embodiment. The graph 100 is identified to include four segments (see, e.g., segments 100*a*, 100*b*, 100*c* and 100*d*) and is an exemplary pictorial representation of a partially-overlapped double document situation.

The first segment 100*a* may generally relate to the orientation of the partially-overlapped documents, $D_1$, $D_4$, as seen in FIGS. 1A and 2A where only the first document, $D_1$, of the pair of documents, $D_1$, $D_4$, traverse the sensor system 14*a*. The orientation of the one or more documents, D, shown in FIGS. 1A and 2A thereby results in some of the light, L, being absorbed in the thickness, $T_1$, and thereby results the digital signal moving away from a saturation value of zero and being equal to approximately about fifty (i.e., approximately about fifty on the zero-to-two-hundred-and-fifty-five scale).

The second segment 100*b* may generally relate to the orientation of the partially-overlapped documents, $D_1$, $D_4$, as seen in FIGS. 1B and 2B where the both of the first and second documents, $D_1$, $D_4$, of the pair of documents, $D_1$, $D_4$, traverse the sensor system 14*a*. The orientation of the one or more documents, D, shown in FIGS. 1B and 2B thereby results in even more of the light, L, being absorbed in the combined thickness, $T_1+T_4$, and thereby results the digital signal moving much further away from the prior value of approximately about fifty (i.e., approximately about fifty on the zero-to-two-hundred-and-fifty-five scale) and being equal to approximately about two hundred (i.e., approximately about two hundred on the zero-to-two-hundred-and-fifty-five scale).

The third segment 100*c* may generally relate to the orientation of the partially-overlapped documents, $D_1$, $D_4$, as seen in FIGS. 1C and 2C where only the second document, $D_4$, of the pair of documents, $D_1$, $D_4$, traverse the sensor system 14*a*. The orientation of the one or more documents, D, shown in FIGS. 1C and 2C thereby results some of the light, L, being absorbed in the thickness, $T_4$, and thereby results the digital signal moving away from the prior value of approximate about two hundred (i.e., approximately about two hundred on the zero-to-two-hundred-and-fifty-five scale) and being equal to approximately about one hundred (i.e., approximately about one hundred on the zero-to-two-hundred-and-fifty-five scale).

Comparatively, because the thickness, $T_4$, of the second document, $D_4$, is greater than the thickness, $T_1$, of the first document, $D_1$, a greater amount of the light, L, is absorbed by the second document, $D_4$, and, as a result, the "second document digital value" related to the third segment 100*c* of approximately about one hundred (i.e., approximately about one hundred on the zero-to-two-hundred-and-fifty-five scale) is greater than the "first document digital value" related to the first segment 100*a* of approximately about fifty (i.e., approximately about fifty on the zero-to-two-hundred-and-fifty-five scale). Further, because the combined thickness, $T_1+T_4$, of both of the first and second documents, $D_1$, $D_4$, is greater than the thickness, $T_4$, of the second document, $D_4$, the "combined first and second document digital value" related to the second segment 100*b* of approximately about two hundred (i.e., approximately about two hundred on the zero-to-two-hundred-and-fifty-five scale) is greater than the "second document digital value" related to the third segment 100*c* of approximately about one hundred (i.e., approximately about one hundred on the zero-to-two-hundred-and-fifty-five scale).

Figure 1D:
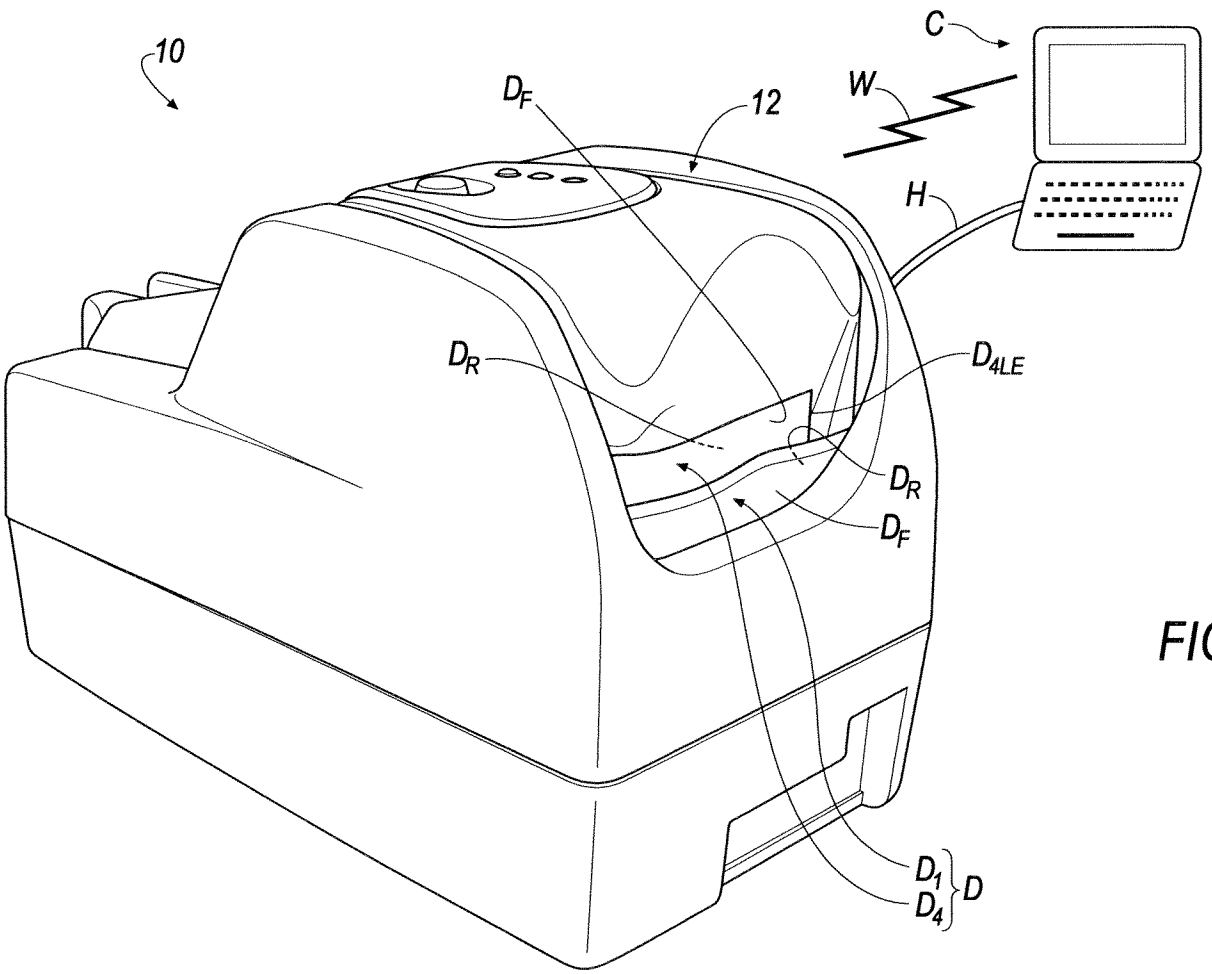
FIGS. 1D-1E illustrate rear perspective views of the exemplary document processing apparatus of FIGS. 1A-1C.
Figure 1E:
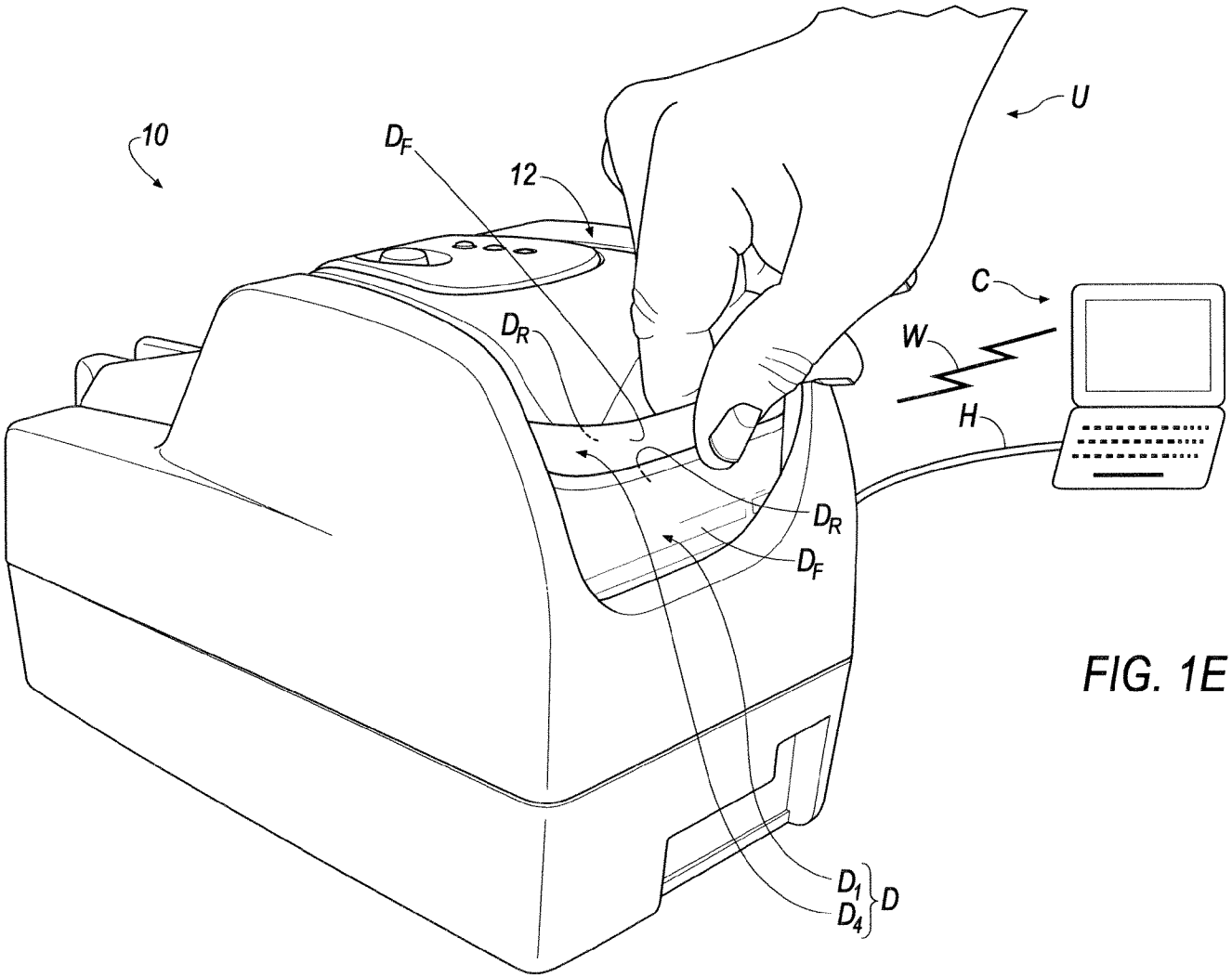

The fourth segment 100*d* may generally relate to the orientation of the partially-overlapped documents, $D_1$, $D_4$, as seen in FIGS. 1D and 1E where neither of the first and second documents, $D_1$, $D_4$, of the pair of documents, $D_1$, $D_4$, traverse the sensor system 14*a*. Because neither of the first and second documents, $D_1$, $D_4$, of the pair of documents, $D_1$, $D_4$, traverse the sensor system 14*a*, that the receiver 14*a*" is substantially saturated by approximately about all of the light, L, due to neither of the first and second documents, $D_1$, $D_4$, being located between the transmitter 14*a*' and the receiver 14*a*". Accordingly, at the fourth segment 100*d*, the graph 100 includes a digital saturation value approximately about zero on the zero-to-two-hundred-and-fifty-five scale.

As seen in FIG. 3, the "Y-axis" includes the digital values ranging between the above-described zero-to-two-hundred-and-fifty-five scale whereas the "X-axis" includes a plurality of instances of samples of the digital sensor value data. The samples on the "X-axis" may include a time component that may relate to, for example, a period of time that the respective thicknesses (i.e., $T_1$ alone for the segment 100*a*, $T_1+T_4$ for the segment 100*b*, $T_4$ alone for the segment 100*c*,) intervene between the transmitter 14*a*' and receiver 14*a*"; alternatively, the samples on the "X-axis" may include a length component that relates to a length of the document that intervenes between the transmitter 14*a*' and the receiver 14*a*".

Referring back to FIGS. 2A-2C, the electronics 14 may further comprise the controller 14*c*. The A-to-D converter 14*b* may be communicatively-coupled to the controller 14*c* for receiving the digital sensor value samples that collectively represent the graph 100. The controller 14*c* may be programmed to include an algorithm, program or logic (see 500 at FIGS. 12A-12B) that will utilize the digital sensor value samples for automatically determining, in real time, a particular "document situation" for the purpose of optimizing operation of the document processor 10. For example, as explained below, the controller 14*c* may utilize one or more of the digital sensor value samples to calculate a threshold value (see, e.g., $TV_{PO}$, in FIGS. 12A-12B) in order to determine if, for example, the document processor 10 is processing a non-overlapped, "single document situation," "partially overlapped double document situation" and "completely overlapped double document situation." If a double document situation is determined, the controller 14*c* may communicate with, for example, the one or more mechanical components 16 to cease routing of the one or more documents, D, along the document path (as seen, e.g., in FIGS. 1D and 1E). Referring to FIG. 1E, once movement of the one or more documents, D, through the document processor 10 has ceased, the user, U, may: (1) remove the one or more documents, D, (2) manually separate the two or more documents, and (3) interface each document (on an individual basis) with the document processor 10 at the input hopper 18.

Although a pictorial representation of a partially-overlapped double document situation (related to FIGS. 11A-11B''') is shown above, the other above-described document situations (related to, e.g., FIGS. 8A-10B) include different digital sensor value characteristics. For example, referring to FIGS. 4-6, a plurality of exemplary digital value samples collectively form graphs 200, 300 and 400 of one or more documents, D, being routed along the document path through the document processor 10; in a substantially similar manner as described above, the algorithm, program or logic 500 may utilize the plurality of exemplary digital value samples collectively forming the graphs 200, 300 and 400 to determine other document situations.

Figure 4:
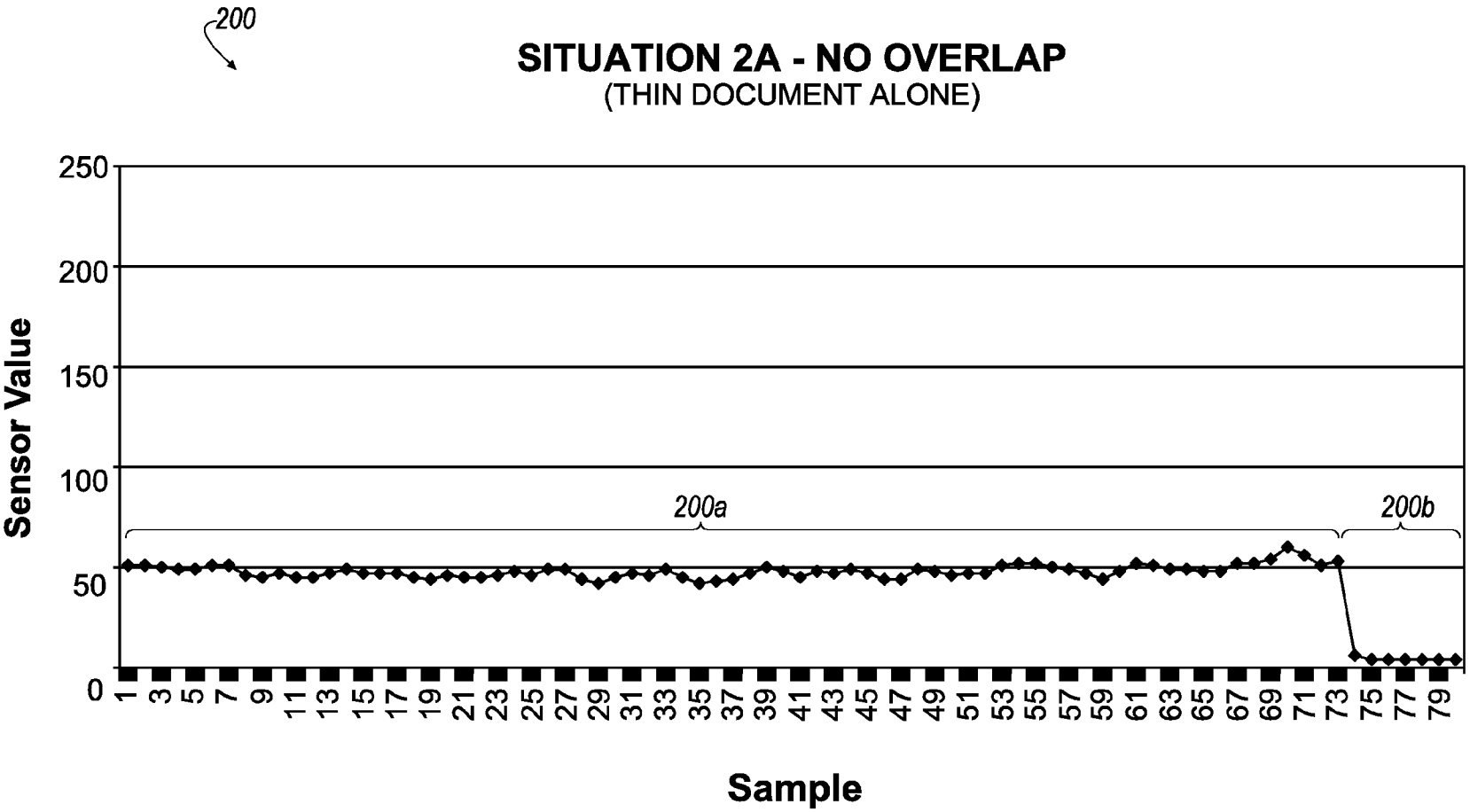
FIG. 4 illustrates an exemplary graph produced by the document processing apparatus that is interacting with single (i.e., non-overlapped) first exemplary document type.

Referring to FIG. 4, the graph 200 generally includes a first segment 200*a* and a second segment 200*b*. The first segment 200*a* includes a "document digital value" of approximately about fifty (i.e., approximately about fifty on the zero-to-two-hundred-and-fifty-five scale) for approximately about ninety-percent (90%) of the plurality of samples whereas the second segment 200*b* includes a digital saturation value approximately about zero on the zero-to-two-hundred-and-fifty-five scale. In an embodiment, the graph 200 may be related to the single document situation of the check, $D_1$, as seen in FIGS. 8A-8B.

Figure 5:
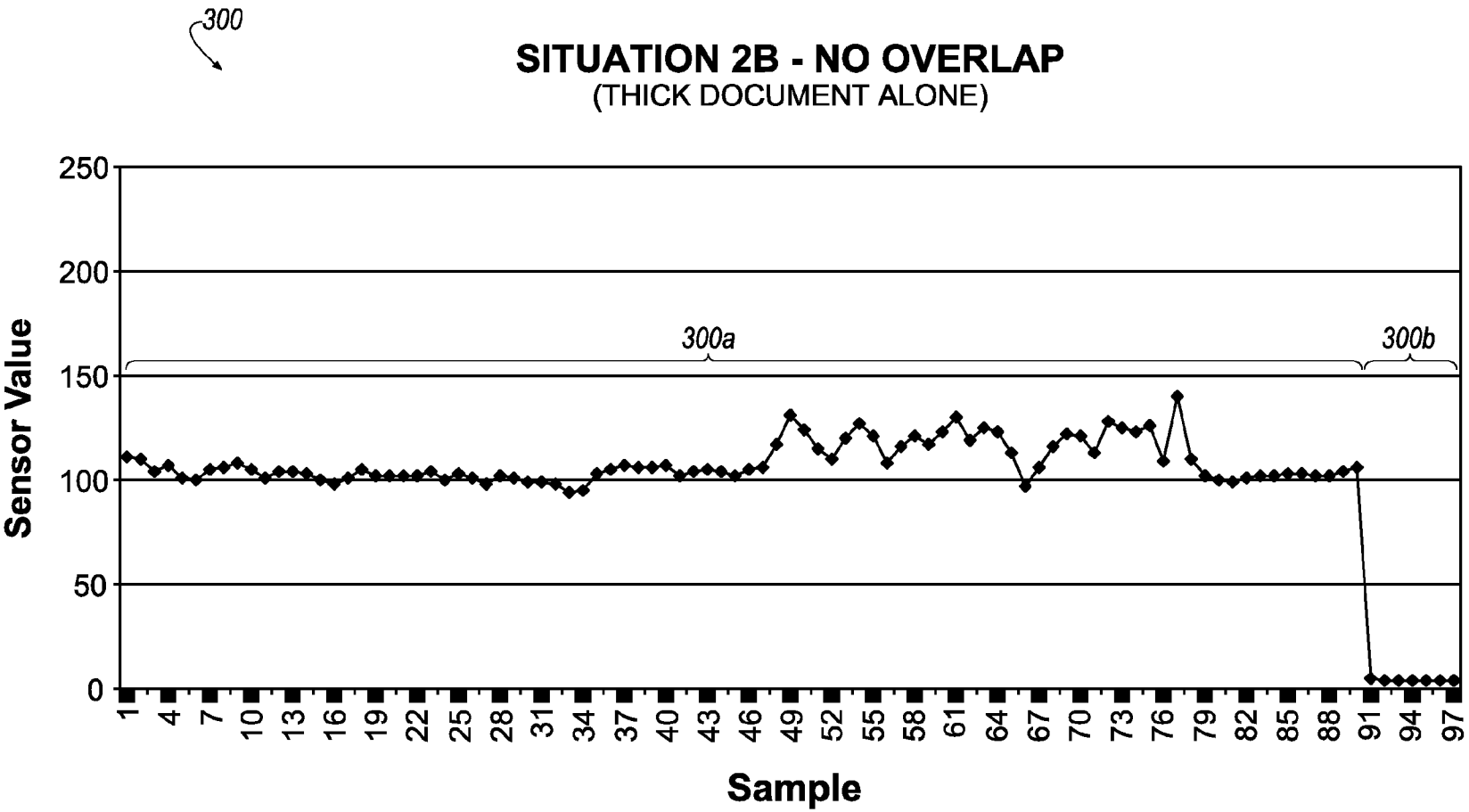
FIG. 5 illustrates an exemplary graph produced by the document processing apparatus that is interacting with a single (i.e., non-overlapped) second exemplary document type.

Referring to FIG. 5, the graph 300 generally includes a first segment 300*a* and a second segment 300*b*. The first segment 300*a* includes a "document digital value" of approximately about one hundred (i.e., approximately about one hundred on the zero-to-two-hundred-and-fifty-five scale) for approximately about ninety-percent (90%) of the plurality of samples whereas the second segment 300*b* includes a digital saturation value approximately about zero on the zero-to-two-hundred-and-fifty-five scale. In an embodiment, the graph 300 may be related to the single document situation of the check, $D_2$, as seen FIGS. 9A-9B.

Figure 6:
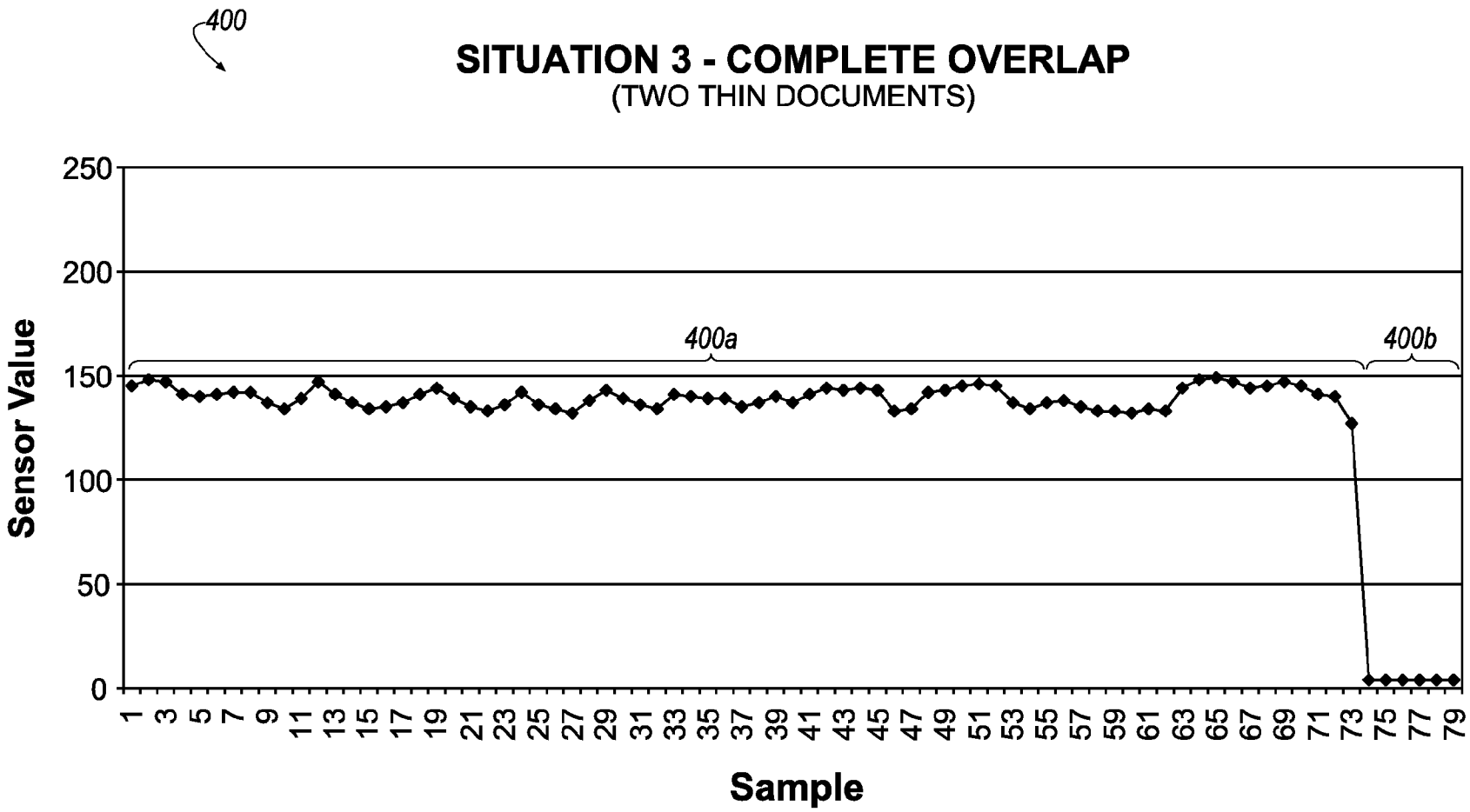
FIG. 6 illustrates an exemplary graph produced by the document processing apparatus that is interacting with two completely overlapped exemplary documents of the same type.

Referring to FIG. 6, the graph 400 generally includes a first segment 400*a* and a second segment 400*b*. The first segment 400*a* includes a "document digital value" of approximately about one-hundred-and-fifty (i.e., approximately about one-hundred-and-fifty on the zero-to-two-hundred-and-fifty-five scale) for approximately about ninety-percent (90%) of the plurality of samples whereas the second segment 400*b* includes a digital saturation value approximately about zero on the zero-to-two-hundred-and-fifty-five scale. In an embodiment, the graph 400 may be related to the completely overlapped double document situation of the documents, $D_{3A}$, $D_{3B}$, of FIGS. 10A-10B.

An embodiment of the algorithm, program or logic 500 at FIGS. 12A-12B of the controller 14*c* is described in further detail below. Firstly, a type of light source (e.g., an infrared light source) of the first pair of light sources 22*a* and the second pair of light sources 22*b* is selected; the type of light source that is selected should have an intensity value that does not saturate the receiver 14*a*'' even when relatively (a) thinner document(s) (such as, e.g., a document that is relatively thinner than that of, for example, the document, $D_1$, as seen in, e.g., FIGS. 8A-8B) is/are interfaced with the document processor 10 (i.e., if the intensity is too great, the light, L, may shine through one or more of the documents, D, and thereby cause the one or more of the exemplary graphs 100, 200, 300 400 above to have a sensor value of approximately about zero for approximately about all of the plurality of samples along the X-axis.

Once the light source is selected, the programmer of the controller 14*c* creates a histogram (see, e.g., FIGS. 7A, 7B) for one or more of the upper light source $22a_U$, $22b_U$ and a lower light source $22a_L$, $22b_L$. Prior to the discussion of the histogram at FIGS. 7A and 7B, a brief overview of the inclusion of four light sources including an upper light source $22a_U$, $22b_U$ and a lower light source $22a_L$, $22b_L$ associated with the transmitter 14*a*' is discussed. The four spaced apart light sources are provided in order to capture a first set of "upper spatial sensor values" and a second set of "lower spatial sensor values" in order to compensate for circumstances where, for example, the document, D, may include, for example, ink on the front surface, $D_F$, of the document, D, that blocks the light, L. The ink may include decorative indicia such as, for example, a large bank logo printed upon the upper corner front surface, $D_F$, of the document, D; accordingly, the upper portion of the document, D, where the bank logo may be located may obscure the light, L, from the upper light source $22a_U$, $22b_U$ and thereby cause the A-to-D converter 14*b* to return a higher sensor value (which could be otherwise improperly construed as a double-document situation when, for example, one check, alone, is being passed in a non-overlapped, single document situation) whereas the lower portion of the document, D, where no bank logo exists may not otherwise obscure the light, L, from lower light source $22a_L$, $22b_L$ and thereby cause the A-to-D converter 14*b* to return a lower sensor value (which would be properly construed as, for example, a non-overlapped, single document situation).

Figure 7A:
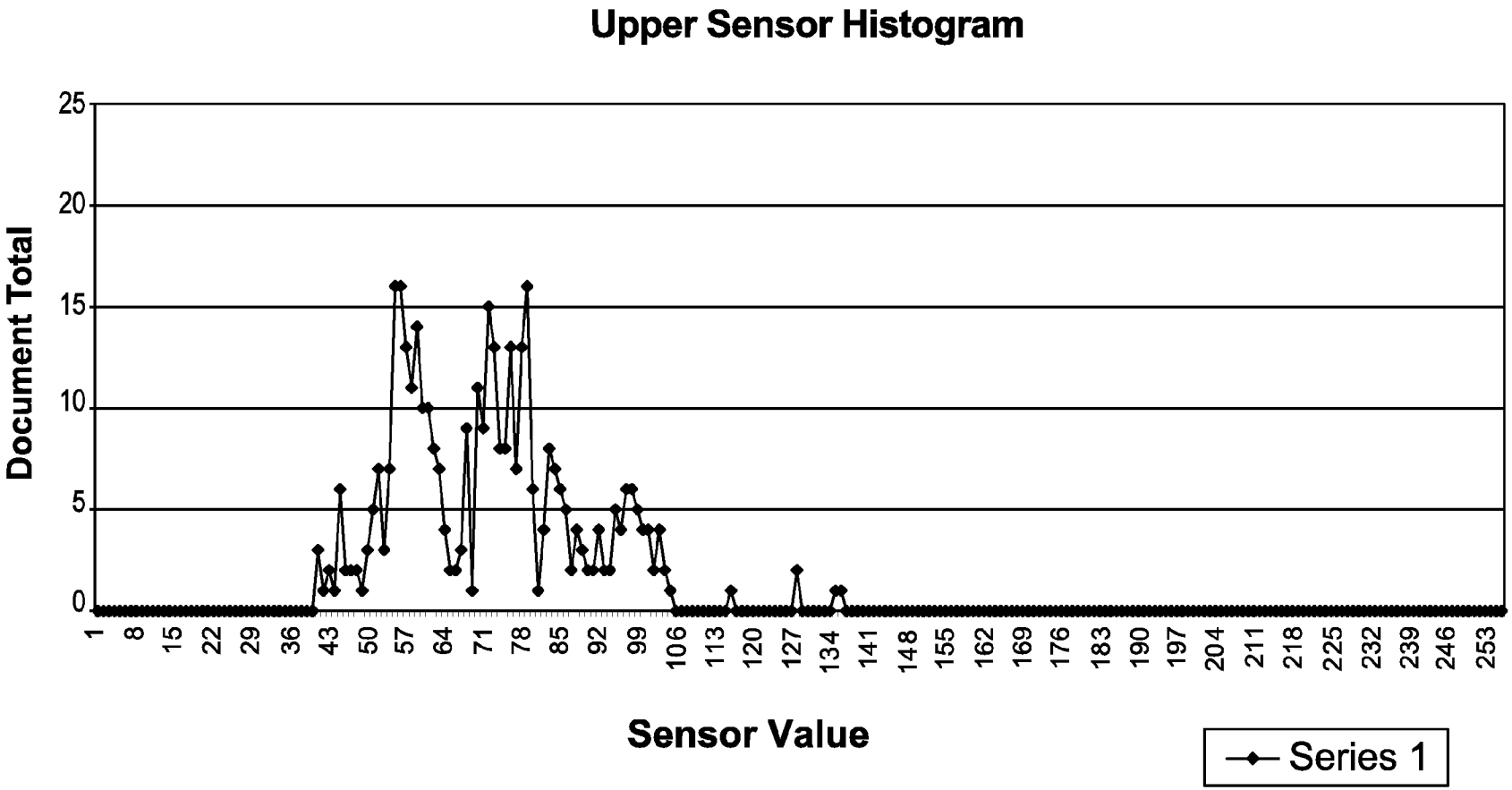
FIG. 7A illustrates a histogram of an upper sensor of the sensor system of FIGS. 2A-2C arising from a plurality of sensing situations conducted by a document processing apparatus.
Figure 7B:
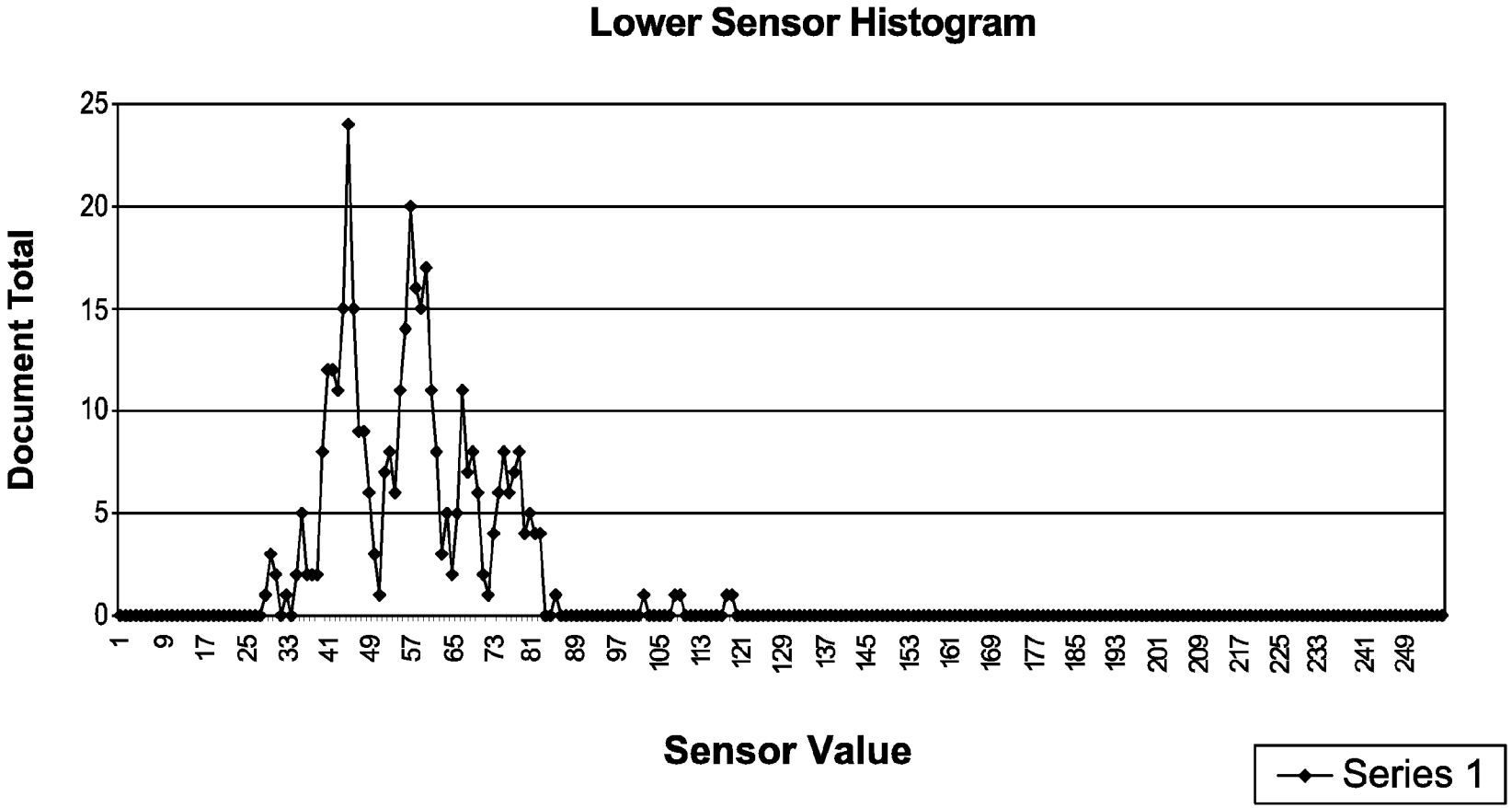
FIG. 7B illustrates a histogram of a lower sensor of the sensor system of FIGS. 2A-2C arising from a plurality of sensing situations conducted by a document processing apparatus.

Referring to FIG. 7A, an exemplary histogram of sensor values on the zero-to-two-hundred-and-fifty-five scale related to the upper light source $22a_U$, $22b_U$ is shown according to an embodiment. Referring to FIG. 7B, an exemplary histogram of sensor values on the zero-to-two-hundred-and-fifty-five scale related to the lower light source $22a_L$, $22b_L$ is shown according to an embodiment. In an embodiment, the histograms of FIGS. 7A and 7B were created by the programmer of the controller 14*c* from a plurality of trial run processing situations (i.e., approximately about three hundred trial run processing situations) of the document processor 10.

The plurality of trial run processing situations that were run by the programmer of the controller 14*c* included a majority of: manually known "non-overlapped, single document situations" (as a result of the programmer manually feeding of the plurality of single documents, $D_1$, $D_2$) and a minority of: manually known "partially overlapped double document situations" (as a result of the programmer manually feeding some partially overlapped documents, $D_1$ and $D_4$) and a minority of: "completely overlapped, double document situations" (as a result of the programmer manually feeding some completely overlapped documents, $D_{3A}$, $D_{3B}$). As an observation, the histogram of FIG. 7A includes a wider spread and higher sensor values (which may have occurred due to, for example, the blocking of the light, L, caused by, for example, a bank logo as described above) when compared to those in FIG. 7B.

In view of the results of the plurality of trial run processing situations shown in FIGS. 7A and 7B, the programmer may elect to utilize histogram sensor values between approximately about 30 and 80 for defining a histogram percentile range. An embodiment of programming the controller 14*c* may include the calculation of a "Completely Overlapped, Double Document Situation Threshold Value" (see: "$TV_{CO}$" in equation 2 below) that includes an "Average Point" (see: "AP" in equation 1 below). As explained below, the "AP" may be derived from approximately about the $25^{th}$ and $75^{th}$ percentile values of the percentile range of either of the histograms of FIGS. 7A and 7B; in the embodiment described in the following pages, the $25^{th}$ and $75^{th}$ percentile values were selected from the histogram of FIGS. 7B.

$$AP=(25^{th}\text{ Percentile Value}+75^{th}\text{ Percentile Value})/2 \quad (1)$$

$$TV_{CO}=AP+((256-AP)\times\text{Multiplier Value}) \quad (2)$$

In addition to the "AP," the $TV_{CO}$ equation also calls for a "Multiplier Value," which is also discussed in greater detail below.

Referring to FIG. 7B, in an embodiment, the $25^{th}$ percentile value may be a sensor value equal to approximately about forty-two (i.e., approximately about forty-two on the zero-to-two-hundred-and-fifty-five scale). With reference to FIG. 7B, the $75^{th}$ percentile value may be a sensor value equal to approximately about sixty-eight (i.e., approximately about sixty-eight on the zero-to-two-hundred-and-fifty-five scale). Accordingly, utilizing equation (1) above, the "AV" may be determined to be a sensor value equal to approximately about fifty-five (i.e., approximately about fifty-five on the zero-to-two-hundred-and-fifty-five scale).

The "Multiplier Value" may be an arbitrary value determined by the programmer of the controller 14*c*. In an embodiment, the programmer may select a "Multiplier Value" equal to approximately about "0.3."

Accordingly, utilizing fifty-five for the "AV" and "0.3" for the "Multiplier Value," equation (2) above may be utilized to determine that the $TV_{CO}$ may be equal to approximately about "115.3" on the zero-to-two-hundred-and-fifty-five scale. In an embodiment, the programmer may then program "115.3" as the $TV_{CO}$ that may utilized in the algorithm 500 as a threshold value that is compared against one or more digital sensor value samples (of, e.g., a plurality of digital value sampled that collectively form, for example, the exemplary graphs 100, 200, 300, 400) to determine if the document situation of one or more documents, D, being processed by the document processor is a "completely overlapped, double document situation."

Although the exemplary "Multiplier Value" is discussed above as being an arbitrary value of "0.3," the invention is not limited to a "Multiplier Value" of "0.3." That is, the "Multiplier Value" may be adjusted by the manufacturer of the document processor 10 and/or the programmer of the controller 14*c* as described below.

For example, the "Multiplier Value" of "0.3" may be an arbitrary value (i.e., the "Multiplier Value" may be kept as "0.3" or adjusted upwardly or downwardly by the programmer; adjustment upwardly or downwardly by the programmer may be dependent upon, for example, how a consumer (e.g., a bank)/user, U, will be utilizing the document processor 10). For example, upon determining that the consumer/user, U, will be processing more than one type of document thickness such as, for example, some relatively thin documents (see, e.g., $D_1$, $D_{3A}$, $D_{3B}$) and some relatively thick documents (see, e.g., $D_2$), the programmer may choose to retain the "Multiplier Value" of 0.3 when programming the controller 14*c* of the document processor. However, upon determining that the user, U, will be not be processing relatively thick documents (see, e.g., $D_2$), the "Multiplier Value" may be reduced to a value of approximately equal to about "0.25;" alternatively, upon determining that the user, U, will not be processing relatively thin documents (see, e.g., $D_1$, $D_{3A}$, $D_{3B}$), the "Multiplier Value" may be increased to a value approximately equal to about "0.35." An exemplary table of Multiplier Values is shown below in Table 1.

TABLE 1

| Designated Type(s) of Documents To Be Processed By The Consumer/User | Programmer-Selected "Multiplier Value" |
|---|---|
| No Thick Documents | 0.25 |
| Some Thin Documents & Some Thick Documents | 0.30 |
| No Thin Documents | 0.35 |

An embodiment of the algorithm 500 may further call for the calculation of a "Partially Overlapped Double Document Situation Threshold Value" (see: $TV_{PO}$ in equation 3 below).

$$TV_{PO}=\text{Lower Sensor Value}+((256-\text{Lower Sensor Value})\times\text{Multiplier Value}) \quad (3)$$

As seen above, the equation for $TV_{PO}$ is substantially similar to the equation for $TV_{CO}$ with the difference being that a "lower sensor value" (of two sensor values) is utilized to calculate $TV_{PO}$ instead of calculating a value for the "AP."

An embodiment of the algorithm 500 may further call for the comparison of a "higher sensor value" against the calculated $TV_{PO}$. Further, the embodiment of the algorithm 500 may further call the determination that if, for example, the $TV_{PO}$ is less than the "higher sensor value," the algorithm 500 will have determined that the document situation is that of a partially overlapped double document situation and cease the processing operation being conducted by the document processor 10.

In order to explain how $TV_{PO}$ is calculated, Table 2 is provided below, which shows twelve successive sensor value samples from the A-to-D converter 14*b* for each of the upper light source 22*$a_U$* and the lower light source 22*$a_L$* of the first pair of light sources 22*a*. The twelve successive sensor value samples may represent, for example, approximately about one-inch of a document containing a partially overlapped document that occurs for about half-of-an-inch. The data is then utilized in Table 3 below (noting that Table 3 only utilizes the values associated with the lower light source 22*$a_L$*).

TABLE 2

| Sensor Value Sample | Sensor Value for $22a_L$ | Sensor Value for $22a_U$ |
|---|---|---|
| 1 | 100 | 125 |
| 2 | 105 | 124 |
| 3 | 103 | 128 |
| 4 | 104 | 122 |
| 5 | 156 | 144 |
| 6 | 161 | 178 |
| 7 | 158 | 174 |
| 8 | 158 | 180 |
| 9 | 162 | 176 |
| 10 | 157 | 181 |

TABLE 2-continued

| Sensor Value Sample | Sensor Value for $22a_L$ | Sensor Value for $22a_U$ |
|---|---|---|
| 11 | 100 | 125 |
| 12 | 95 | 123 |

Upon obtaining at least three sensor values samples from Table 2, each row in Table 3 (shown below) may be populated with data. As seen in Table 3 below, the first sensor value sample (e.g., '100' from Table 2 in relation to the Sensor Value Sample '1' of the lower sensor 22$a_L$) is compared to the second sample (e.g., '105' from Table 2 in relation to the Sensor Value Sample '2' of the lower sensor 22$a_L$) in order to determine which of the first and second sensor values has a "lower value" and which sensor value has a "higher value." In the first instance, the lower value is '100,' and, as a result, '100' is utilized as a variable in calculating the $TV_{PO}$ (i.e., '146.8' on the zero-to-two-hundred-and-fifty-five scale); after calculating $TV_{PO}$ (e.g., by software within the controller 14*c*), the controller 14*c* determines (with, e.g., software) if the $TV_{PO}$ is less than the higher value (i.e., by comparing values '100' and '105,' with the higher value of the two values being '105').

Next, the controller 14*c* determines if the $TV_{PO}$ (of '146.8' in the above-described first instance) is less than the higher value (of '105' in the above-described first instance); because '146.8' is not less than '105,' the methodology then considers the second subsequent sensor value (e.g., '103' from Table 2 in relation to the Sensor Value Sample '3' of the lower sensor 22$a_L$). As seen in Table 3, the first sensor value sample (e.g., '100' from Table 2 in relation to the Sensor Value Sample '1' of the lower sensor 22$a_L$) is compared to the second subsequent sensor value sample (e.g., '103' from Table 2 in relation to the Sensor Value Sample '3' of the lower sensor 22$a_L$) in order to determine which of the first and second subsequent sensor values has a "lower value" and which sensor value has a "higher value." The lower value of the two is '100,' and, as a result, '100' is utilized as a variable in calculating the $TV_{PO}$ (i.e., '146.8' on the zero-to-two-hundred-and-fifty-five scale); after calculating $TV_{PO}$ (e.g., by software within the controller 14*c*), the controller 14*c* determines (with, e.g., software) if the $TV_{PO}$ is less than the higher value (i.e., by comparing values '100' and '103,' with the higher value of the two values being '103').

After determining that the $TV_{PO}$ is still not less than the higher value (arising from the second subsequent sensor value of '103'), the methodology (as seen in Trial 2 of Table 3) then discards the previous first sensor value sample (e.g., '100' from Trial 1 of Table 3) and replaces the first sensor value with the value of the previous subsequent sensor value (i.e., '105' from Trial 1 of Table 3). Similarly, as seen in Trial 2 of Table 3, the methodology discards the previous subsequent sensor value (i.e., '105' from Trial 1 of Table 3) and replaces the subsequent sensor value with the previous second subsequent sensor value (i.e., '103' from Trial 1 of Table 3). The methodology also discards the previous second subsequent sensor value (i.e., '103' from Trial 1 of Table 3) and replaces the second subsequent sensor value with the next available data value from Table 2 (e.g., '104' from Table 2 in relation to the Sensor Value Sample '4' of the lower sensor 22$a_L$).

The above methodology is repeated until the controller 14*c* determines that the $TV_{PO}$ is less than the higher value. Referring to Trial 3 of Table 3, the controller 14*c* determines that the $TV_{PO}$ is less than the higher value, and, as a result, a leading edge (see, e.g., $D_{4LE}$, in FIGS. 2A-2C) of a second document (i.e., $D_4$) will have said to be been detected and a partially-overlapped double document situation is declared; however, if the $TV_{PO}$ is greater than the higher value (see, e.g., Trials 1 and 2 in Table 3), the leading edge is said to not be detected.

In view of the data from Table 2 and the above-discussed aspect of the algorithm 500, Table 3 is populated with data as shown in an embodiment below. As seen below for the rows related to Trials 3 and 4, the right-most column indicates that $TV_{PO}$ is less than the higher value and a leading edge of a second document is said to be detected for declaring that a partially-overlapped double document situation has occurred; the trailing edge (see, e.g., $D_{1TE}$, in FIGS. 2A-2C) of the first document (i.e., $D_1$) of the double document situation is then similarly located in the row related to Trials 9 and 10, thereby confirming the partial overlap double document situation.

TABLE 3

| Trial | First Sensor Value Sample | Subsequent Sensor Value | Second Subsequent Sensor Value | Lower Value of the First Sensor Value and Subsequent Sensor Values | Lower Value of the First Sensor Value and Second Subsequent Sensor Values | Higher Value of the First Sensor Value and Subsequent Sensor Values | Higher Value of the First Sensor Value and Second Subsequent Sensor Values | $TV_{PO}$ (Derived from First Lower Value) | $TV_{PO}$ (Derived from Second Lower Value) | Is $TV_{PO}$ < the Matching Higher Value? |
|---|---|---|---|---|---|---|---|---|---|---|
| 1 | 100 | 105 | 103 | 100 | 100 | 105 | 103 | 146.8 | 146.8 | No |
| 2 | 105 | 103 | 104 | 103 | 104 | 105 | 105 | 148.9 | 149.6 | No |
| 3 | 103 | 104 | 156 | 103 | 103 | 156 | 156 | 148.9 | 148.9 | Yes |
| 4 | 104 | 156 | 161 | 104 | 104 | 161 | 161 | 149.6 | 149.6 | Yes |
| 5 | 156 | 161 | 158 | 156 | 156 | 161 | 158 | 186.0 | 186.0 | No |
| 6 | 161 | 158 | 158 | 158 | 158 | 161 | 161 | 187.4 | 187.4 | No |
| 7 | 158 | 158 | 162 | 158 | 158 | 162 | 162 | 187.4 | 187.4 | No |
| 8 | 158 | 162 | 157 | 158 | 157 | 158 | 158 | 187.4 | 186.7 | No |
| 9 | 162 | 157 | 100 | 157 | 100 | 162 | 162 | 186.7 | 146.8 | Yes |
| 10 | 157 | 100 | 95 | 100 | 95 | 157 | 157 | 143.3 | 143.3 | Yes |

Figure 12A:
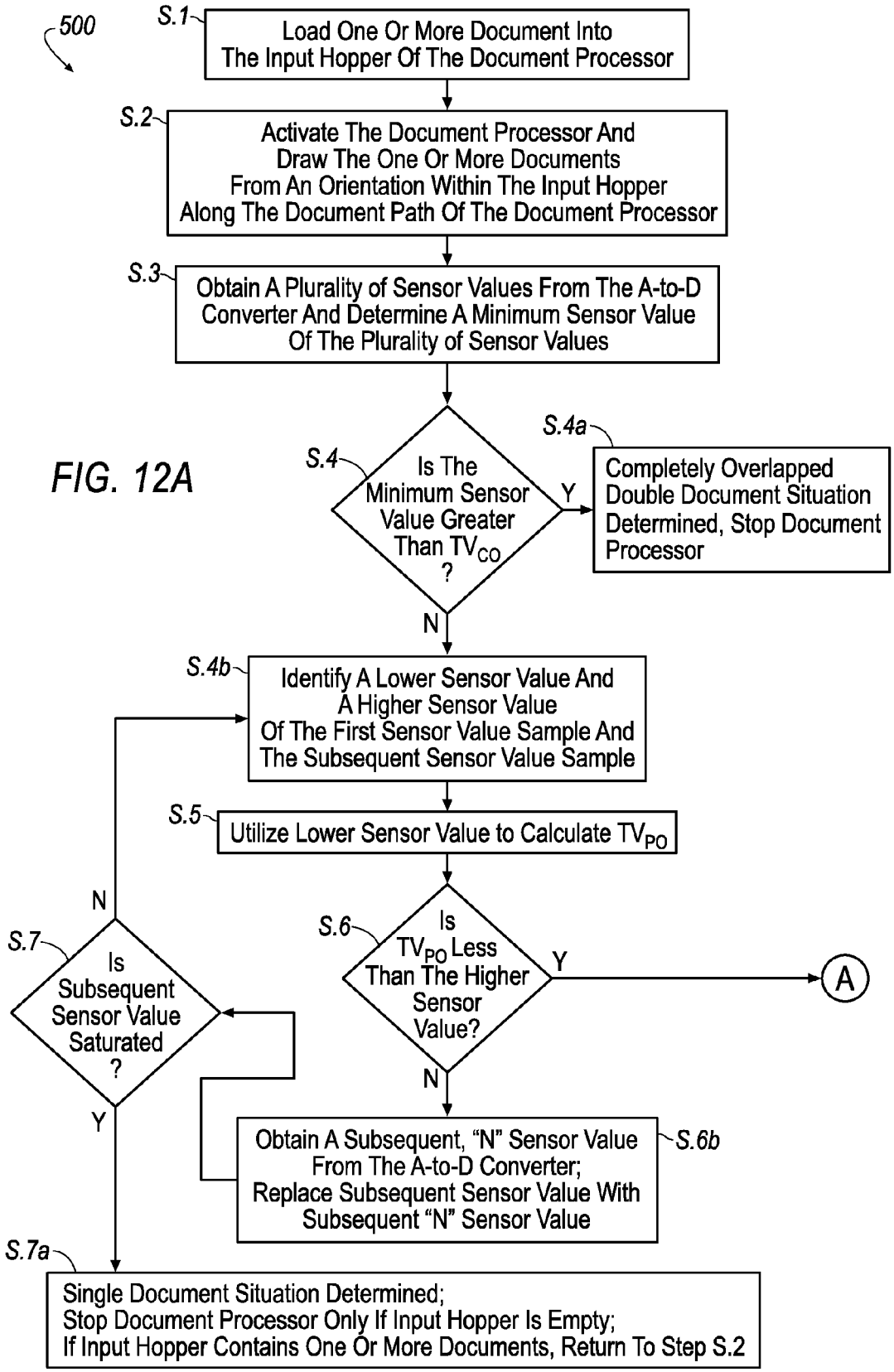
FIGS. 12A-12B is a logic flow diagram of an exemplary algorithm for operating the document processor of FIGS. 1A-1E.
Figure 12B:
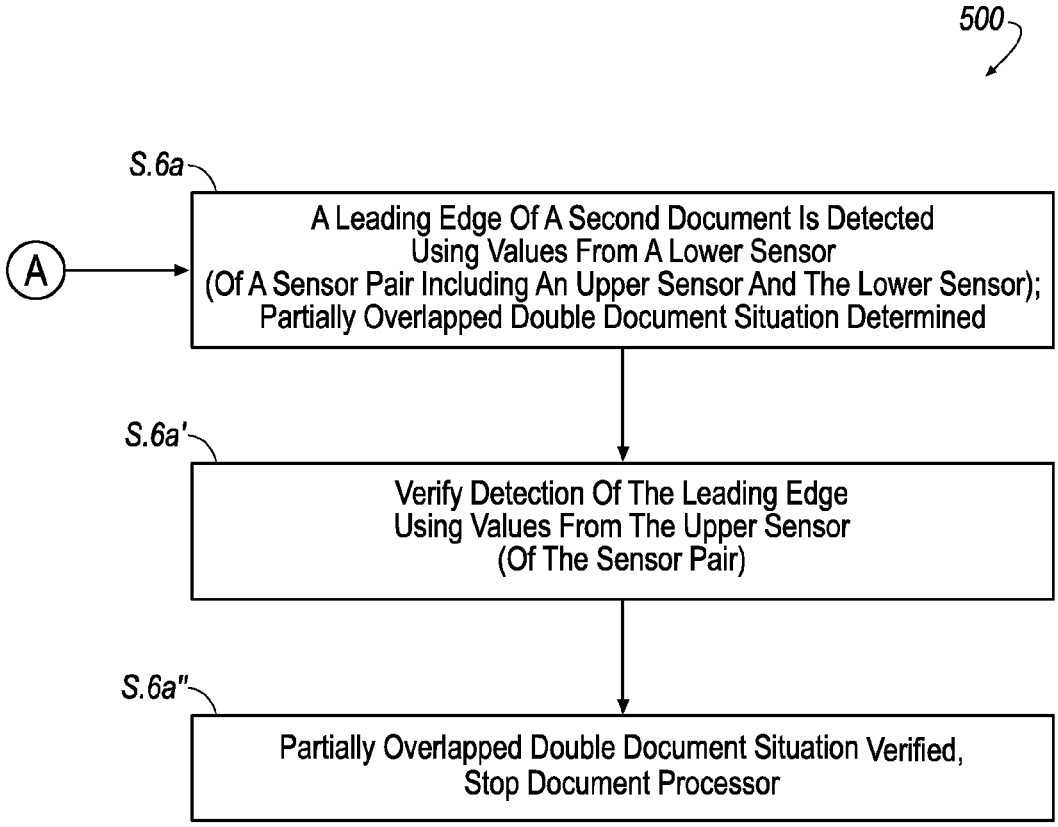

Referring to FIGS. 12A-12B, an exemplary algorithm 500 is described according to an embodiment. First, at step S.1, one or more documents, D, are loaded into the input hopper 18 of the document processor 10. Then, at step S.2, the user, U, may activate the document processor 10 by, for example, manually pressing a start button on the document processor 10 or the computer, C, such that the one or more mechanical components 16 may start moving the one or more documents, D, along the document path. Alternatively, the document processor 10 may include a sensor (not shown) that senses if the one or more documents, D, have been placed/are located in the input hopper 18; if the one or more documents, D, are sensed, the electronics 14 may cause the one or more mechanical components 16 to start moving the one or more documents, D, along the document path.

Then, at step S.3, the A-to-D converter 14*b* provides a plurality of digital sensor values (on the zero-to-two-hundred-and-fifty-five scale) to the controller 14*c* as described above (i.e., one of an exemplary graph 100, 200, 300, 400 is created). The controller 14*c* may include memory that for storing the plurality of digital sensor values. Step S.3 may also include the step of the controller 14*c* determining (by way of software) a minimum digital sensor value of the plurality of digital sensor values.

Then, at step S.4, the controller 14*c* (using software) determines if the determined minimum digital sensor value is greater than the programmed $TV_{CO}$ that was coded into the controller 14*c* by the programmer. If the controller 14*c* determined, at step S.4, that the determined minimum digital sensor value is greater than the programmed $TV_{CO}$, the algorithm 500 is advanced from step S.4 to S.4*a* where the controller 14*c* communicates with the one or more mechanical components 16 in order to instruct the one or more mechanical components to cease advancing the one or more documents, D, along the document path (i.e., by arriving at step S.4*a*, the electronics 14 have determined that a "completely overlapped double document situation" has occurred) such that the user, U, may manually resolve (see FIG. 1E) the double document situation. If, however, the controller 14*c* determined, at step S.4, that the determined minimum digital sensor value is not greater than the programmed $TV_{CO}$, the algorithm 500 is advanced from step S.4 to S.4*b* where continued analysis of the document situation of one or more documents, D, is carried out (i.e., in order to determine if the document situation is a non-overlapped, single document situation or a partially-overlapped double document situation).

At step S.4*b* (and with reference to, for example, the lower sensor values of $22a_L$ in Table 2 and Table 3, above), the controller 14*c* (by using software) determines the "lower sensor value" and the "higher sensor value" of the first digital value sample and the subsequent (i.e., the second) digital value sample. Then, at step S.5, the controller 14*c* (by using software) calculates $TV_{PO}$. Then, at step S.6, the controller 14*c* (using software) determines if the calculated $TV_{PO}$ is less than the determined "higher sensor value." If the controller 14*c* determined, at step S.6, that the calculated $TV_{PO}$ is less than the determined "higher sensor value," the algorithm 500 is advanced from step S.6 to S.6*a* (see FIG. 12B), which is explained in greater detail below.

If, however, the controller 14*c* determined, at step S.6, that the calculated $TV_{PO}$ is not less than the determined "higher sensor value." the algorithm 500 is advanced from step S.6 to S.6*b* where the subsequent (i.e., the second) digital value sample from the plurality of digital sensor values is substituted with that of the next (i.e., a third) digital value sample from the plurality of digital sensor values. The algorithm is then advanced to step S.7 where the controller 14*c* (by way of software) determines if the subsequent (i.e., the "next"/third) digital value sample is saturated. If the subsequent digital value is not saturated, the algorithm 500 is looped from step S.7 back to step S.4*b* (however, prior to returning to step S4.*b* from step S.7, the first digital value sample is replaced with the second digital value sample, and, the third digital value sample that was read at step S.6*b* now becomes the second digital value sample for the subsequent logic loop starting at step S.4*b*). If, however, at step S.7, it is determined that the subsequent digital value is saturated, the algorithm 500 is advanced to step S.7*a* where continued processing of the document, D, is permitted (due to the algorithm 500 determining that the document situation is a non-overlapped, single document situation). As step S.7*a*, if the input hopper 18 does not contain a document, D, the document processor 10 may be manually/automatically deactivated; however, at step S.7*a*, if the input hopper 18 contains one or more documents, D, the document processor 10 continues operating and the algorithm is looped back to step S.2 where subsequent one or more documents is/are analyzed to determine the single/double document situation of the subsequent document.

As seen in FIG. 12A, the algorithm 500 may remain in a loop at step S.4*b*, step S.5, step S.6, step S.6*b* and step S.7 until the calculated $TV_{PO}$ is less than the determined "higher sensor value" at step S.6. If, for example, the calculated $TV_{PO}$ is determined (by the controller 14*c*) to be less than the determined "higher sensor value" at step S.6, the algorithm 500 may exit the loop (at steps S.4*b*-S.7) and advance from step S.6 to step S.6*a*.

Referring to FIG. 12B, at step S.6*a*, the determination that the calculated $TV_{PO}$ is less than the determined "higher sensor value" means that a leading edge (e.g., $D_{4LE}$) of a second document (e.g., $D_4$) of a partially overlapped document situation (see, e.g., $D_1$, $D_4$, of FIGS. 11A-11B''') may have been located. The algorithm 500 may then be advanced from step S.6*a* to step S.6*a*' where the detection of the leading edge (e.g., $D_{4LE}$) of the second document (e.g., $D_4$) is verified. The verification at step S.6*a*' includes the use of the upper sensor values of $22a_U$ from Table 2 with that of the methodology employed by the lower sensor values of $22a_L$ from Table 2 described above at steps S.4*b*, S.5 and S6. If verified at step S.6*a*', the algorithm 500 is then advanced from step S.6*a*' to step S.6*a*" where the controller 14*c* communicates with the one or more mechanical components 16 in order to instruct the one or more mechanical components to cease advancing the one or more documents, D, along the document path (i.e., by arriving at step S.6*a*", the electronics 14 have determined that a "partially overlapped double document situation" has occurred) such that the user, U, may manually resolve (see FIG. 1E) the double document situation.

For teaching purposes herein, the exemplary embodiments have been described using the aid of a graphical/pictorial-based representation of a collection of data including a histogram. However, one skilled in the art will readily recognize that no such graphical/pictorial-based implementations are need to implement the present invention using a digital computer. Specifically, the data sample could be stored in ascending or descending order (within digital memory) and the desired percentile cut-off points (such as, for example, 25% or 75%) can be easily determined from the ordered data. Accordingly, the implementation of the algorithms disclosed herein is not limited to a graphical/pictorial-based display of data.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A method, comprising the steps of:

interfacing one or more documents with a document processor: routing the one or more documents along a document path of the document processor; and determining a document processing situation of a plurality of document processing situations of the one or more documents, wherein the plurality of document processing situations include a single document situation, and a double document situation, wherein the double document situation includes a partially-overlapped, double document situation, and a completely overlapped, double document situation, wherein, prior to the determining step, further comprising the steps of: transmitting an amount of light across the document path from a light transmitter to a light receiver; utilizing the light receiver to derive an analogue signal that is based upon the transmitted amount of light; communicating the analogue signal from the light receiver to an analogue-to-digital converter; utilizing the analogue-to-digital converter to derive a digital signal from the analogue signal; communicating the digital signal to a controller for conducting the determining the document processing situation step, wherein the digital signal includes a plurality of sensor value samples; determining a minimum sensor value of the plurality of sensor value samples; determining that the document situation is the completely overlapped, double document situation if the determined minimum sensor value is greater than a pre-programmed complete overlap threshold value; utilizing one of at least two sensor value samples of the plurality of sensor value samples for determining a partially overlapped threshold value; and determining that the document situation is the partially-overlapped, double document situation if the partially overlapped threshold value is less than the other of the at least two sensor value samples.

2. A method, comprising the steps of:

interfacing one or more documents with a document processor; routing the one or more documents along a document path of the document processor; and determining a document processing situation of a plurality of document processing situations of the one or more documents, wherein the plurality of document processing situations include a single document situation, and a double document situation, wherein the double document situation includes a partially-overlapped, double document situation, and a completely overlapped, double document situation, wherein, prior to the determining step, further comprising the steps of: transmitting an amount of light across the document path from a light transmitter to a light receiver; utilizing the light receiver to derive an analogue signal that is based upon the transmitted amount of light; communicating the analogue signal from the light receiver to an analogue-to-digital converter; utilizing the analogue-to-digital converter to derive a digital signal from the analogue signal; communicating the digital signal to a controller for conducting the determining the document processing situation step, wherein the digital signal includes a plurality of sensor value samples; determining a minimum sensor value of the plurality of sensor value samples; determining that the document situation is the completely overlapped, double document situation if the determined minimum sensor value is greater than a pre-programmed complete overlap threshold value; (a) determining a minimum sensor value of the plurality of sensor value samples; and determining that the document situation is the completely overlapped, double document situation if the determined minimum sensor value is greater than a pre-programmed complete overlap threshold value, (b) utilizing one of at least two sensor value samples of the plurality of sensor value samples for determining a partially overlapped threshold value; and determining that the document situation is the partially-overlapped, double document situation if the partially overlapped threshold value is less than the other of the at least two sensor value samples, and (c) if the completely overlapped, double document situation and the partially-overlapped, double document situation are not determined, determining that the document situation is the single document situation.

3. A method, comprising the steps of:

interfacing one or more documents with a document processor; routing the one or more documents along a document path of the document processor; and determining a document processing situation of a plurality of document processing situations of the one or more documents, wherein the plurality of document processing situations include a single document situation, and a double document situation, wherein the double document situation includes a partially-overlapped, double document situation, and a completely overlapped, double document situation, wherein, prior to the determining step, further comprising the steps of transmitting an amount of light across the document path from a light transmitter to a light receiver; utilizing the light receiver to derive an analogue signal that is based upon the transmitted amount of light; communicating the analogue signal from the light receiver to an analogue-to-digital converter; utilizing the analogue-to-digital converter to derive a digital signal from the analogue signal; communicating the digital signal to a controller for conducting the determining the document processing situation step, wherein the digital signal includes a plurality of sensor value samples; determining a minimum sensor value of the plurality of sensor value samples; determining that the document situation is the completely overlapped, double document situation if the determined minimum sensor value is greater than a pre-programmed complete overlap threshold value utilizing one of at least two sensor value samples of the plurality of sensor value samples for determining a partially overlapped threshold value that relates to detecting a leading edge or a trailing edge of one of a first document and a second document of the one or more documents that are partially-overlapped for determining that the document situation is the partially-overlapped, double document situation if the partially overlapped threshold value is less than the other of the at least two sensor value samples.

4. The apparatus according to claim 3, wherein the detecting step includes:

detecting the leading edge of the second document and not detecting the leading edge of the first document and not detecting the trailing edge of one of the first document and the second document.

* * * * *